US009663962B1

(12) United States Patent
Whittemore

(10) Patent No.: US 9,663,962 B1
(45) Date of Patent: May 30, 2017

(54) POLE MOUNT AND METHODS OF INSTALLATION AND APPLICATION

(71) Applicant: Zipwall LLC, Arlington, MA (US)

(72) Inventor: Jeffrey P. Whittemore, Arlington, MA (US)

(73) Assignee: Zipwall, LLC., Arlington, MA (US)

( * ) Notice: Subject to any disclaimer, the term of this patent is extended or adjusted under 35 U.S.C. 154(b) by 0 days.

(21) Appl. No.: 14/597,641

(22) Filed: Jan. 15, 2015

Related U.S. Application Data

(60) Provisional application No. 61/928,482, filed on Jan. 17, 2014, provisional application No. 62/049,681, filed on Sep. 12, 2014.

(51) Int. Cl.

| | |
|---|---|
| ***A47H 1/00*** | (2006.01) |
| ***E04G 21/24*** | (2006.01) |
| ***E04G 21/30*** | (2006.01) |
| ***A47H 13/00*** | (2006.01) |
| *E04G 25/06* | (2006.01) |

(52) U.S. Cl.
CPC ..... *E04G 21/243* (2013.01); *A47H 13/00* (2013.01); *E04G 21/24* (2013.01); *E04G 21/30* (2013.01); *E04G 25/065* (2013.01)

(58) Field of Classification Search
CPC ..... E04G 21/243; E04G 25/06; E04G 25/065; E04G 2025/042; E04G 2025/045; E04G 2025/047; E04G 25/04; Y10T 403/32467; Y10T 403/32475; Y10T 403/32483; Y10T 403/32491; Y10T 403/32501; Y10T 403/595; Y10T 403/599; F17B 37/0828; F17B 37/0864
USPC ..... 160/330, 350, 351, 368.1; 411/433; 403/299; 248/354.3
See application file for complete search history.

(56) References Cited

U.S. PATENT DOCUMENTS

| | | | | |
|---|---|---|---|---|
| 642,236 | A | 1/1900 | Larimer | |
| 827,000 | A | 7/1906 | Dinsmore | |
| 1,705,625 | A | 3/1929 | Mitchell | |
| 1,766,324 | A | 6/1930 | Berner | |
| 2,118,361 | A * | 5/1938 | Schaeffer, Jr. ..... | F16B 37/0821 292/305 |
| 2,219,169 | A | 10/1940 | Alter | |
| 2,232,194 | A | 2/1941 | Zogby | |
| 2,474,158 | A | 6/1949 | Neely | |

(Continued)

FOREIGN PATENT DOCUMENTS

| | | |
|---|---|---|
| DE | 3918516 | 6/1989 |
| DE | 4420849 | 12/1995 |

(Continued)

OTHER PUBLICATIONS

"Quickprop", Brochure by Protecta Screen LTD, Aug. 1996.

(Continued)

*Primary Examiner* — Katherine Mitchell
*Assistant Examiner* — Jeremy Ramsey
(74) *Attorney, Agent, or Firm* — Onello & Mello, LLP

(57) ABSTRACT

A pole mount includes a telescoping, length-adjustable pole having a head end and a foot end, a coarse length-adjustment mechanism, and a fine length-adjustment mechanism. The fine length-adjustment mechanism is proximal to the foot end of the pole and the coarse length-adjustment mechanism is at an end of a segment of the telescoping pole nearest the head end of the pole.

27 Claims, 16 Drawing Sheets

(56) References Cited

U.S. PATENT DOCUMENTS 2,487,585 A 11/1949 Pencek
2,816,769 A 12/1957 Noble
2,903,227 A 9/1959 de Kalb Key
2,942,829 A 6/1960 Stiffel
3,072,784 A 1/1963 Mann
3,090,826 A 5/1963 Cochran
3,118,363 A 1/1964 Burgess, Jr.
3,247,558 A 4/1966 Kaufman
3,322,381 A 5/1967 Bubb
3,327,310 A 6/1967 Bethune et al.
3,333,808 A 8/1967 Du Boff
3,350,120 A 10/1967 Hinrichs
3,433,510 A 3/1969 Hulterstrum
3,529,860 A 9/1970 Jelley
3,592,434 A 7/1971 Murray
3,604,397 A 9/1971 Salerno
3,608,991 A 9/1971 Wade
3,713,643 A 1/1973 Gerstenberger
3,767,253 A 10/1973 Kluetsch
3,792,510 A 2/1974 Evett
3,822,850 A * 7/1974 Elias ..... E04G 21/3233 248/200.1
3,856,421 A * 12/1974 Nogler ..... E04G 5/02 248/354.3
3,858,988 A 1/1975 Cohen
3,861,663 A 1/1975 Strickland
3,863,554 A 2/1975 Boyd
3,952,877 A 4/1976 Kindl
3,956,784 A 5/1976 Vargas
3,972,272 A 8/1976 Bagby
3,994,463 A 11/1976 Baker
4,077,083 A 3/1978 Siemund et al.
4,078,756 A 3/1978 Cross
4,087,006 A 5/1978 Schill
4,111,217 A 9/1978 Victor
4,127,911 A 12/1978 Cupp et al.
4,139,101 A 2/1979 Towfigh
4,277,863 A 7/1981 Faneuf
4,379,654 A 4/1983 Rovelli
4,396,325 A 8/1983 Joice-Cavanagh
4,488,651 A 12/1984 Bishop
4,502,256 A 3/1985 Hahn
4,536,924 A 8/1985 Willoughby
4,576,354 A 3/1986 Blessing, Sr.
4,586,844 A 5/1986 Hammonds et al.
4,592,797 A 6/1986 Carlson
4,645,473 A 2/1987 Mochizuki
4,662,034 A 5/1987 Cunningham
4,708,189 A 11/1987 Ward
4,715,089 A 12/1987 Schema
4,717,107 A 1/1988 Servadio
4,770,086 A 9/1988 Gabster
4,794,974 A 1/1989 Melino
4,824,302 A 4/1989 Schultheis et al.
4,852,844 A 8/1989 Villaveces
4,874,028 A 10/1989 Lynch et al.
4,885,876 A 12/1989 Henke
4,907,835 A 3/1990 Salters
4,912,814 A 4/1990 McKenzie
4,926,522 A 5/1990 Wang
4,928,916 A 5/1990 Molloy
4,949,523 A 8/1990 Kassem
4,969,241 A 11/1990 Griffin
5,038,889 A 8/1991 Jankowski
5,040,915 A 8/1991 Stuart et al.
5,056,753 A * 10/1991 Lunau ..... A47K 17/02 248/200.1
5,078,348 A 1/1992 Babitchenko
5,116,012 A 5/1992 Offenhauer et al.
5,129,774 A 7/1992 Balseiro et al.
5,131,781 A 7/1992 Klein
5,170,974 A 12/1992 Ruggiero
5,240,058 A 8/1993 Ward
5,287,614 A 2/1994 Ehrlich
5,299,773 A 4/1994 Bertrand
5,301,915 A 4/1994 Bahniuk et al.
5,308,280 A 5/1994 Dotson
5,331,706 A 7/1994 Graham
5,345,989 A 9/1994 Brophy
5,375,303 A 12/1994 Shenier
5,379,491 A 1/1995 Solo
5,384,938 A 1/1995 Frederick
5,388,283 A 2/1995 Garnett
5,400,959 A 3/1995 Cone
5,404,602 A 4/1995 Kondo
5,469,607 A 11/1995 Henningsson et al.
5,497,537 A 3/1996 Robinson et al.
5,524,693 A 6/1996 Hamilton
5,529,326 A 6/1996 Hwang
5,536,229 A 7/1996 Albergo
5,542,209 A 8/1996 Sheu
5,555,607 A 9/1996 Parveris
5,558,501 A 9/1996 Wang et al.
5,584,456 A 12/1996 Stephens
5,640,826 A 6/1997 Hurilla
5,645,272 A 7/1997 Brennan, Sr.
5,647,607 A 7/1997 Bolieau
5,649,780 A 7/1997 Schall
5,666,702 A 9/1997 Ming-Chieh
5,673,741 A 10/1997 Cairns
5,685,112 A 11/1997 Fara
5,707,032 A 1/1998 Ehrlich
5,715,620 A 2/1998 Walker
5,722,691 A 3/1998 Patel
5,803,653 A 9/1998 Zuffetti
5,832,652 A 11/1998 Bartys
5,884,424 A 3/1999 Smith
5,897,085 A 4/1999 Cronin
5,918,843 A 7/1999 Stammers
5,924,469 A * 7/1999 Whittemore ..... A47H 21/00 160/351
5,937,488 A 8/1999 Geiger
5,940,942 A 8/1999 Fong
5,941,434 A 8/1999 Green
5,941,586 A 8/1999 Fann
5,944,464 A 8/1999 Cole, Jr.
5,979,110 A 11/1999 Tai
6,053,527 A 4/2000 Gans et al.
6,067,691 A 5/2000 Feltman
6,082,945 A 7/2000 Jeffries et al.
6,152,434 A 11/2000 Gluck
6,164,605 A 12/2000 Drake et al.
6,170,112 B1 1/2001 Mayfield et al.
6,209,615 B1 * 4/2001 Whittemore ..... A47H 21/00 160/350
6,237,182 B1 5/2001 Cassar
6,321,823 B1 11/2001 Whittemore
6,341,401 B1 1/2002 Lin
6,378,175 B1 4/2002 Vanderpan
6,467,741 B1 * 10/2002 Shih ..... E04G 25/06 248/200.1
6,474,609 B1 11/2002 Pinard
6,490,749 B1 12/2002 Morad
6,508,295 B2 1/2003 Whittemore
6,523,231 B1 2/2003 Lassiter
6,729,358 B1 5/2004 Moffatt
6,908,250 B2 6/2005 Moffatt
6,942,004 B2 9/2005 Whittemore
6,953,076 B2 10/2005 Whittemore
7,108,040 B2 9/2006 Whittemore
7,261,140 B2 8/2007 Whittemore
7,479,593 B1 * 1/2009 Townsend ..... G10D 13/06 248/635
7,503,373 B2 3/2009 Whittemore
7,533,712 B2 5/2009 Whittemore et al.
7,658,219 B2 2/2010 Whittemore
8,066,051 B2 11/2011 Whittemore
8,371,360 B2 2/2013 Whittemore
8,471,133 B1 * 6/2013 Lin ..... G10D 13/06 84/421
2001/0029640 A1 10/2001 Cassar
2002/0011316 A1 1/2002 Whittemore
2003/0028988 A1 2/2003 Streutker et al.
2003/0070773 A1 4/2003 Whittemore

(56) References Cited

U.S. PATENT DOCUMENTS

| | | | |
|---|---|---|---|
| 2003/0154588 | A1 | 8/2003 | Blacket et al. |
| 2004/0065799 | A1 | 4/2004 | Whittemore et al. |
| 2004/0200585 | A1 | 10/2004 | Whittemore |
| 2005/0247414 | A1 | 11/2005 | Whittemore |
| 2005/0284591 | A1 | 12/2005 | Whittemore |
| 2006/0272785 | A1 | 12/2006 | Whittemore |
| 2008/0006374 | A1 | 1/2008 | Whittemore |
| 2009/0071614 | A1 | 3/2009 | Whittemore |
| 2010/0108849 | A1 | 5/2010 | Whittemore |
| 2012/0049034 | A1 | 3/2012 | Whittemore |
| 2015/0052843 | A1 | 2/2015 | Whittemore |

FOREIGN PATENT DOCUMENTS

| | | | |
|---|---|---|---|
| DE | 29605222 | 7/1996 | |
| EP | 0976351 | 2/2000 | |
| FR | 2411282 | 6/1979 | |
| GB | 1042086 | 9/1966 | |
| GB | 2156894 | 10/1985 | |
| GB | 2325397 | 11/1998 | |
| JP | 2001503487 | 3/2001 | |
| JP | 2003206640 | 7/2003 | |
| WO | 8603538 | 6/1986 | |
| WO | 9109556 | 7/1991 | |
| WO | 94/27480 | 12/1994 | |
| WO | WO 2015048513 A1 * | 4/2015 | ..... E04G 25/06 |

OTHER PUBLICATIONS

"Third Hand", Brochure by FastCap, LLP, 2003.0.
"Curtain-Wall", Brochure by Curtain-Wall.com, Feb. 2000.
Mllx Co., Ltd. "Magic Wall". http:/www1.mllx.co.jp/.
"Mr. Long Arm", Brochure by Mr. LongArm, Inc., 2004.
North American Marketing Representatives, Inc. "Power Pole". http:/www.waldmannbenches.com/power5205pole520content.htm (Nov. 2004).
"Snapwall Temporary Wall Support", brochure by C&S Manufacturing Inc.
"KwikPole", Brochure by KwikPole, Inc. www.kwikpole.com/setup.html (Aug. 2003).

* cited by examiner

POLE MOUNT AND METHODS OF INSTALLATION AND APPLICATION

RELATED APPLICATIONS

This application claims the benefit of U.S. Provisional Patent Application Ser. No. 61/928,482, filed Jan. 17, 2014 and U.S. Provisional Patent Application Ser. No. 62/049,681, filed Sep. 12, 2014 the content of each being incorporated herein by reference in its entirety.

This application is related to: U.S. Pat. No. 5,924,469, issued Jul. 20, 1999; U.S. Pat. No. 6,564,512, issued May 20, 2003; U.S. Pat. No. 7,073,758, issued Jul. 11, 2006; U.S. Pat. No. 7,533,712, issued May 19, 2009; U.S. Pat. No. 7,658,219, issued Mar. 2, 2010; U.S. Pat. No. 7,670,401, issued Feb. 9, 2010; U.S. Pat. No. 7,743,512, issued Jun. 29, 2010; U.S. Pat. No. 7,717,382, issued May 18, 2010; U.S. patent application Ser. No. 14/517,062, filed Oct. 17, 2014; and U.S. patent application Ser. No. 12/889,968, filed Sep. 24, 2010, the content of each being incorporated herein by reference in its entirety.

Embodiments of the pole mount of the present patent application may be used in connection with the technology of any of the above patents or patent applications.

BACKGROUND

Partition mounting systems are employed to isolate portions of a building or room, by serving as a barrier to dust, noise, light, odors, and the like.

SUMMARY

In commercial construction applications, for example in parking lots and at airports, it is desired that pole mounts for partition systems be held in place securely, in adverse conditions. Partition mounting systems in commercial construction, specifically, used outside, must be able to withstand adverse weather conditions, for example, wind.

Embodiments of the present inventive concepts are directed to a pole mount and methods of installation and application.

In one aspect, embodiments of the present inventive concepts include a pole mount including a telescoping, length-adjustable pole having a head end and a foot end. The pole mount further includes a coarse length-adjustment mechanism and a fine length-adjustment mechanism. In some embodiments, the fine length-adjustment mechanism is proximal to the foot end of the pole. In some embodiments, the coarse length-adjustment mechanism is at and an end of each segment of the telescoping pole nearest the head end of the pole.

In some embodiments, the pole includes a plurality of telescoping segments.

In some embodiments, an anchor is secured to and within a narrowest segment of the pole, at a position proximal to the head end of the pole.

In some embodiments, a head extends from the head end of the pole and travels in a direction along the longitudinal axis of the pole relative to the anchor position within the pole.

In some embodiments, the head includes: a first portion, a portion of which extends into an interior of the pole; and a second portion that extends transverse to the first portion; and a compression mechanism that biases the position of the head in an outward direction away from the anchor.

In some embodiments, the anchor is constructed and arranged to limit outward extension of the head in the outward direction, and wherein the head includes a stop that travels in relative motion with the head in the direction along the longitudinal axis of the pole, wherein the stop interfaces with the anchor to limit the outward extension of the head in the outward direction.

In some embodiments, the fine length-adjustment mechanism comprises: a quick-release mechanism that engages and disengages a female threaded portion having female threads, the quick-release mechanism fixedly coupled to a foot end of the pole; and a threaded rod having a male thread corresponding to the female thread, such that when the quick release mechanism is in an engaged position the threaded rod slides freely through the female threaded portion and such that when the quick-release mechanism is in a disengaged position, the male thread and female threaded portion are engaged and can be rotated relative to each other.

In some embodiments, the pole mount further comprises: a foot coupled to an end of the threaded rod; and a pivot between the foot and threaded rod so that the foot and threaded rod pivot relative to each other.

In some embodiments, the quick release mechanism further comprises a pedal that engages and disengages the female threaded portion.

In some embodiments, the fine adjustment mechanism includes a pedal and thread quick release mechanism at the foot end of the pole. The fine adjustment mechanism provides micro-adjustment of the pole length. In some embodiments, the fine adjustment mechanism provides for fine control of the amount of outward extension of the foot relative to a foot end of a widest of the pole segments.

In some embodiments, the pole may further include a compression meter which indicates when a maximum longitudinal force is exceeded.

In some embodiments, the maximum longitudinal force is applied when the head is in a "bottomed out" position; that is in a position where a lower surface of a portion of the head is in direct contact with an upper surface of a head end of the narrowest segment of the pole.

In some embodiments, the compression meter may include a spring and a visual indicator such that when the spring of the compression meter is compressed to a predefined point, the visual indicator indicates that a predetermined longitudinally oriented compression force has been applied to the pole system.

In some embodiments, the visual indicator may comprise a painted ring that becomes covered when the maximum force is applied.

In another aspect, a pole mount comprises: a telescoping, length-adjustable pole having a head end and a foot end; a coarse length-adjustment mechanism, wherein the coarse length-adjustment mechanism comprises: an anchor secured to and within a narrowest segment of the pole, at a position proximal to the head end of the pole; a head extending from the head end of the pole and traveling in a direction along the longitudinal axis of the pole relative to the anchor position within the pole; and a compression mechanism that biases the position of the head in an outward direction away from the anchor, wherein the anchor is constructed and arranged to limit outward extension of the head in the outward direction, and wherein the head comprises a stop that travels in relative motion with the head in the direction along the longitudinal axis of the pole, wherein the stop interfaces with the anchor to limit the outward extension of the head in the outward direction; and a fine length-adjustment mechanism, wherein the fine length-adjustment mechanism is proximal to the foot end of the pole and the coarse length-adjustment mechanism is at an end of a segment of the telescoping pole nearest the head end of the pole, the fine length-adjustment mechanism comprising: a quick-release mechanism that engages and disengages a female threaded portion having female threads, the quick-release mechanism fixedly coupled to a foot end of the pole; and a threaded rod having a male thread corresponding to the female thread, such that when the quick release mechanism is in an engaged position the threaded rod slides freely through the female threaded portion and such that when the quick-release mechanism is in a disengaged position, the male thread and female threaded portion are engaged and can be rotated relative to each other.

In some embodiments, the head comprises: a first portion, a portion of the first portion extending into an interior of the pole; and a second portion that extends transverse to the first portion.

In some embodiments, the pole mount further comprises: a foot coupled to an end of the threaded rod; and a pivot between the foot and threaded rod so that the foot and threaded rod pivot relative to each other.

In some embodiments, the quick release mechanism further comprises a pedal that engages and disengages the female threaded portion.

In some embodiments, the pole mount further comprises a compression meter indicating when a maximum longitudinal force is exceeded.

In some embodiments, the maximum longitudinal force is applied when the head is in a position where a lower surface of a portion of the head is in direct contact with an upper surface of a head end of the narrowest segment of the pole.

In some embodiments, the compression meter comprises a spring and a visual indicator such that, when the spring of the compression meter is compressed to a predefined point, the visual indicator indicates that a predetermined longitudinally oriented compression force has been applied to the pole system.

In some embodiments, the visual indicator comprises a painted ring or reflective material that becomes obstructed when the maximum force is applied.

In another aspect, a pole mount, comprises: a length-adjustable pole; a length-adjustment mechanism that adjusts a length of the pole; a compression meter indicating when a maximum applied longitudinal force is exceeded, wherein the compression meter comprises a spring and a visual indicator such that, when the spring of the compression meter is compressed to a predefined point, the visual indicator indicates that a predetermined longitudinally oriented compression force has been applied to the pole by the length-adjustment mechanism.

In some embodiments, the visual indicator comprises a painted ring or reflective material that becomes obstructed when the maximum force is applied.

In some embodiments, the length-adjustment mechanism comprises: a quick-release mechanism that engages and disengages a female threaded portion having female threads, the quick-release mechanism fixedly coupled to the pole; and a threaded rod having a male thread corresponding to the female thread, such that when the quick release mechanism is in an engaged position the threaded rod slides freely through the female threaded portion and such that when the quick-release mechanism is in a disengaged position, the male thread and female threaded portion are engaged and can be rotated relative to each other.

BRIEF DESCRIPTION OF THE DRAWINGS

The foregoing and other objects, features and advantages of embodiments of the present inventive concepts will be apparent from the more particular description of preferred embodiments, as illustrated in the accompanying drawings in which like reference characters refer to the same elements throughout the different views. The drawings are not necessarily to scale, emphasis instead being placed upon illustrating the principles of the preferred embodiments.

DETAILED DESCRIPTION OF EMBODIMENTS

Figure 1A:
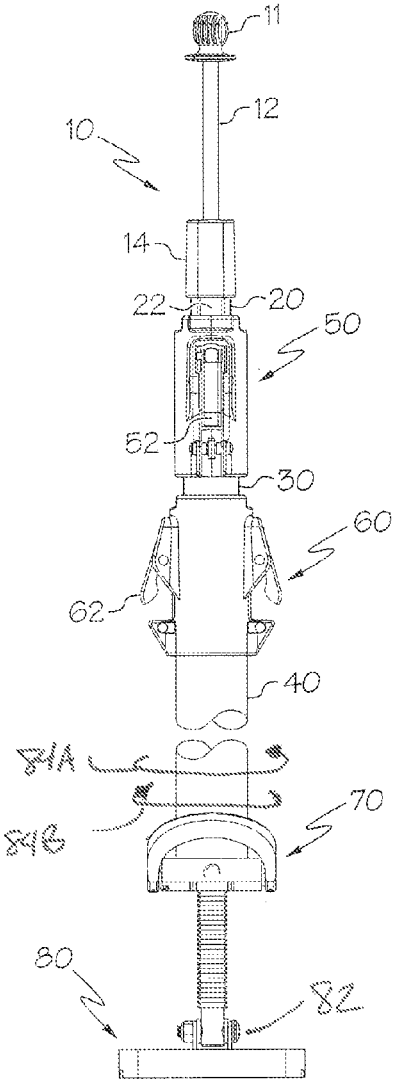
FIG. 1A is a first side view of a pole mount in accordance with embodiments of the present inventive concepts.

Various example embodiments will be described more fully hereinafter with reference to the accompanying drawings, in which some example embodiments are shown. The present inventive concepts may, however, be embodied in many different forms and should not be construed as limited to the example embodiments set forth herein.

It will be understood that when an element or layer is referred to as being "on," "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present inventive concepts.

Spatially relative terms, such as "beneath," "below," "lower," "above," "upper" and the like, may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of the present inventive concepts. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Example embodiments are described herein with reference to cross-sectional illustrations that are schematic illustrations of idealized example embodiments (and intermediate structures). As such, variations from the shapes of the illustrations as a result, for example, of manufacturing techniques and/or tolerances, are to be expected. Thus, example embodiments should not be construed as limited to the particular shapes of regions illustrated herein but are to include deviations in shapes that result, for example, from manufacturing. Thus, the regions illustrated in the figures are schematic in nature and their shapes are not intended to illustrate the actual shape of a region of a device and are not intended to limit the scope of the present inventive concepts.

Figure 1C:
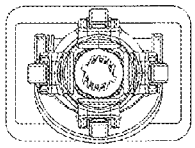
FIG. 1C is a top view of a pole mount of FIG. 1A in accordance with embodiments of the present inventive concepts.
Figure 1B:
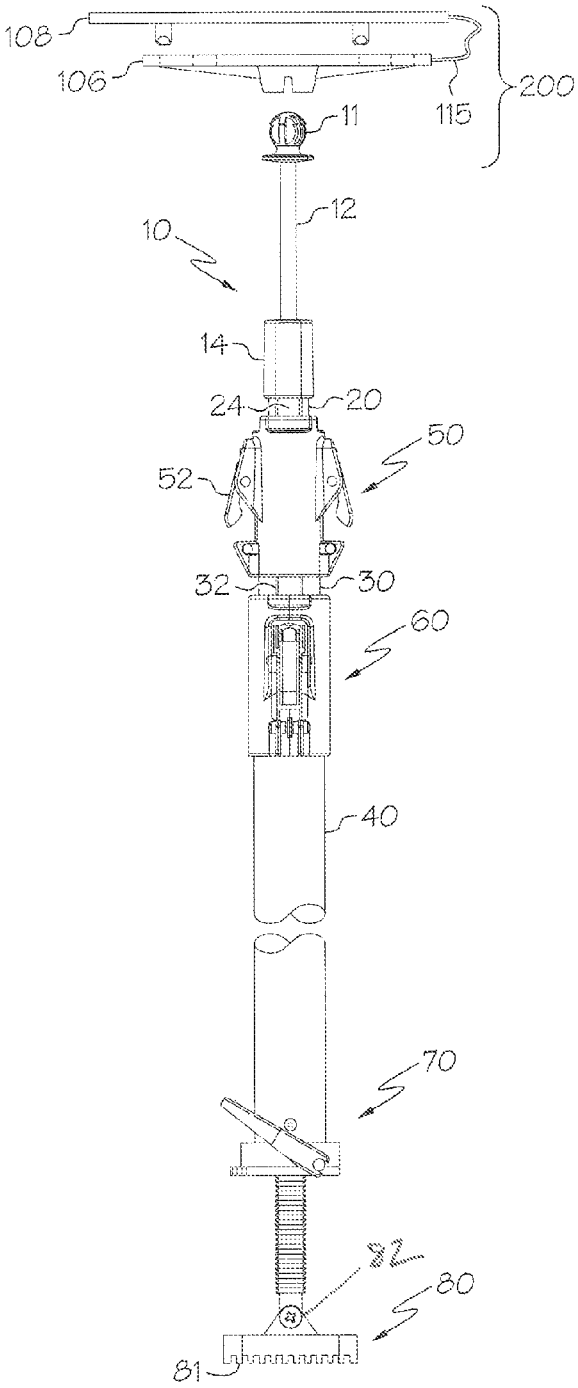
FIG. 1B is a second side view of a pole mount of FIG. 1A in accordance with embodiments of the present inventive concepts.
Figure 2A:
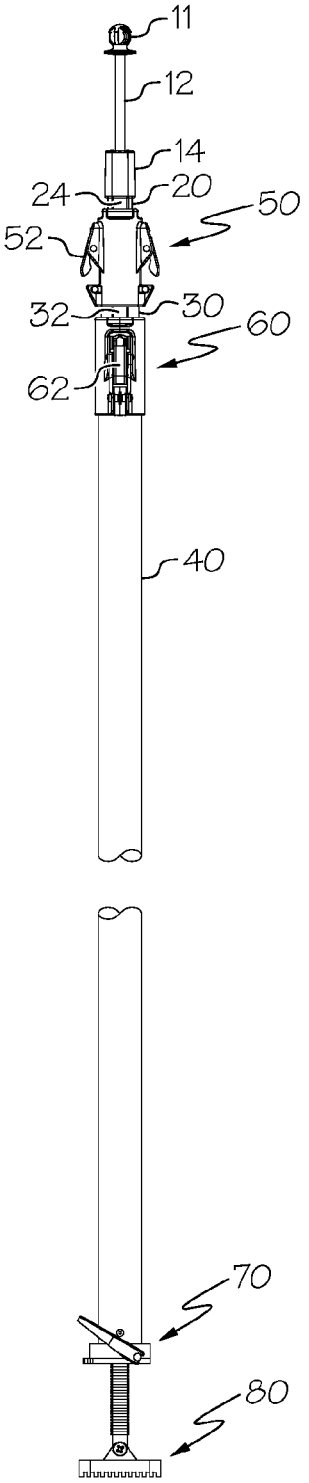
FIG. 2A is a side view of the pole mount of FIG. 1 in a collapsed position and FIG. 2B is a side view of the pole mount of FIG. 2 in an extended position in accordance with embodiments of the present inventive concepts.
Figure 2B:
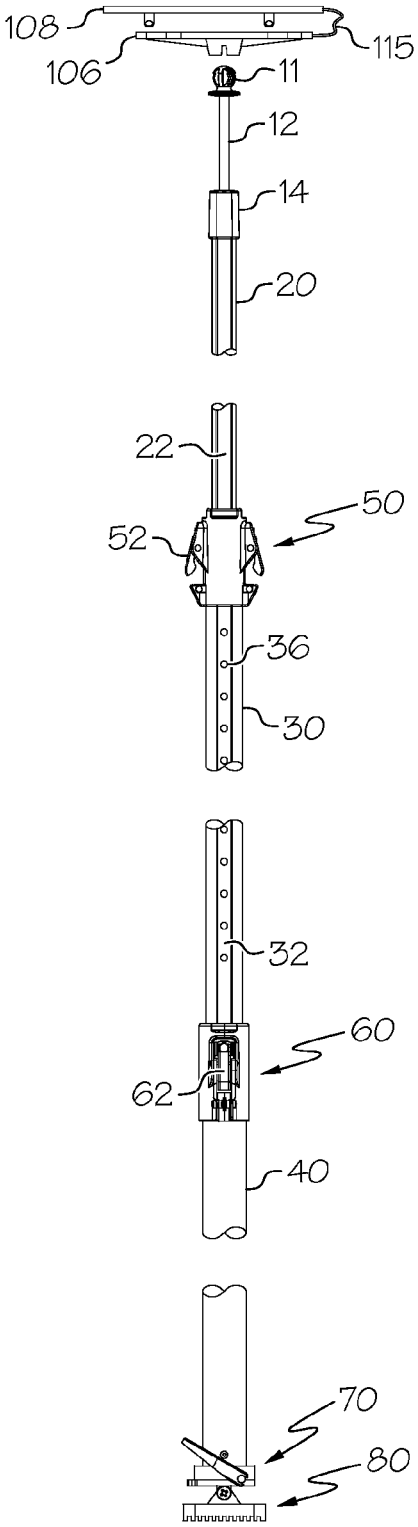

FIG. 1A is a first side view of a pole mount in accordance with embodiments of the present inventive concepts. FIG. 1B is a second side view of a pole mount of FIG. 1A in accordance with embodiments of the present inventive concepts. FIG. 1C is a top view of a pole mount of FIG. 1A in accordance with embodiments of the present inventive concepts. FIG. 2A is a side view of the pole mount of FIG. 1 in a collapsed position and FIG. 2B is a side view of the pole mount of FIG. 2 in an extended position in accordance with embodiments of the present inventive concepts.

In some embodiments, a pole mount 10 comprises a telescoping, length-adjustable pole 20, 30, 40. In some embodiments, the pole is adapted for use in adverse conditions, and therefore is constructed and arranged to withstand a longitudinally applied compressive force. In some embodiments, the pole mount can withstand 185 pounds of longitudinally compressive force. In some embodiments, the pole mount can withstand 250 pounds of longitudinally compressive force. In some embodiments, the pole mount can withstand a longitudinally compressive force greater than 250 pounds. In this manner, the pole system is suitable for use in connection with commercial construction applications. For example, the pole mount 10 may be securely mounted between, for example, a fixed concrete ceiling and a fixed concrete floor and positioned in place with outwardly applied longitudinal force operable on a ceiling and floor of a room. In some embodiments, for example as shown in the illustrative diagram of FIGS. 10A and 10B, multiple pole mounts 10 can be positioned between a floor and a ceiling of a room. A sheet of material can be coupled to an upper portion of the pole mounts and below a lower portion of the pole mounts as shown to create a partition, as shown. Forces, such as a change of air pressure, breeze or wind, operating on the sheet of material, create a lateral force that in turn operates on the pole mounts 10. By providing pole mounts 10 with heightened compressive force capability, the pole mounts 10 can be mounted and reinforced by application of additional compressive force once in position. In this manner, the resulting system is further capable of withstanding adverse conditions, for example withstanding adverse weather conditions.

Figure 6B:
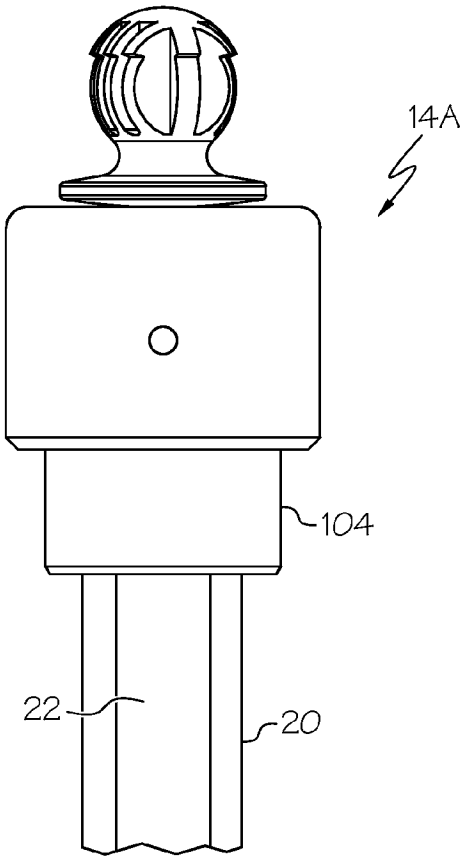
FIG. 6B is a side view of the compression meter of the pole mount of FIG. 6A in a compressed state in accordance with embodiments of the present inventive concepts.

The pole mount 10 is illustrated as including three telescoping pole segments 20, 30 and 40; however, the present inventive concepts are not limited thereto. For example, in various embodiments, the pole mount can include a single pole segment, two pole segments, or more than three pole segments. A cap 14 is positioned at an end of the innermost pole segment 20. The innermost pole segment 20 moves relative to the intermediate pole segment 30 in a telescoping arrangement and is locked into a position using a locking mechanism 50. The locking mechanism 50 is positioned at an end of the intermediate pole segment 30. In some embodiments, the locking mechanism 50 includes spring-loaded pins and levers 52. The innermost pole segment 20 includes a plurality of indexed holes 26, as illustrated in FIG. 6D, extending in a longitudinal direction along the innermost pole segment 20. The indexed holes are constructed and arranged to communicate with the spring-loaded pins and levers 52 of the locking mechanism. The locking mechanism 50 includes spring-loaded pins which are retracted when levers 52 are inwardly pushed or squeezed, and released when the levers 52 are released. When the spring-loaded pins are retracted, the innermost pole segment 20 may move freely within the intermediate pole segment 30. When the spring-loaded pins are released, the spring-loaded pins are released into one of the indexed holes 26 of the innermost pole segment 20, thereby locking the innermost pole segment 20 in place relative to the intermediate pole segment 30.

The intermediate pole segment 30 moves relative to the outermost pole segment 40 in a telescoping arrangement and is locked into a position using a locking mechanism 60. The locking mechanism 60 is positioned at an end of the outermost pole segment 40. The locking mechanism 60 includes spring-loaded pins and levers 62. The innermost pole includes indexed holes 36, as illustrated in FIG. 2B, extending in a longitudinal direction along the intermediate pole 30. The locking mechanism 60 include a spring-loaded pins which are retracted when the levers 62 are pushed or squeezed in and released when the levers are released. When the spring-loaded pins are retracted, the intermediate pole segment 30 may move freely within the outermost pole segment 40. When the spring-loaded pins are released, the spring-loaded pins are released into one of the indexed holes 36 of the intermediate pole 30, thereby locking the intermediate pole 30 in place relative to the outermost pole segment 40.

In some embodiments, the locking mechanisms 50 and 60 including the corresponding levers and spring-loaded pins 52 are robust in form and can withstand the relatively large amount of compressive longitudinal pressure, and any lateral forces, exerted by or on the pole mount 10.

In some embodiments, one or more of the telescoping poles segments 20 and 30 each include at least one flat longitudinally oriented surface, namely, flat surfaces 22, 24 and 32. In some embodiments the innermost pole segment 20 is primarily square in cross-section and the intermediate pole segment 30 is primarily circular in cross-section with two flat outer surfaces. In some embodiments, the telescoping pole 20 may include four flat surfaces. In some embodiments, the telescoping pole 30 may include two flat surfaces on two rounded surfaces. The outermost telescoping pole segment 40 is illustrated as having round surfaces; however, the present inventive concepts are not limited thereto. The flat outer surfaces on the pole segments mate with flat inner surfaces of the locking mechanisms. This prevents the pole segments 20, 30, 40 from twisting relative to each other, thereby strengthening the resulting system, and ensuring engagement between the levers and spring-loaded pins 52, 62 and the corresponding indexed holes 26, 36.

In some embodiments, a head 200 extends from the head end of the innermost pole segment 20 and travels in a longitudinal direction along the longitudinal axis of the pole. The head 200 includes a rod 12, the rod in turn including a first end which extends into an interior of the pole and a second end having a ball joint 11. The head 200 is described in further detail in connection with FIG. 3.

A fine adjustment mechanism 70 is positioned at the foot end of the pole. In some embodiments, the fine adjustment mechanism is coupled at the foot end of the outermost pole segment 40, that is, the widest segment of the pole. In some embodiments, the fine adjustment mechanism 70 comprises a pedal and thread quick-release mechanism. The structure and operation of the fine adjustment mechanism is described in further detail in connection with FIG. 4 and FIGS. 5A-5D.

A foot 80 is positioned at the foot end of the pole. The foot 80 includes a lower surface including grips for gripping the surface of the floor. The foot 80 may be, for example, rectangular, square, oval or circular. The foot 80 may include rounded or curved edges. The foot 80 may be of a size such that the foot 80 may be coupled with or rested within a cup or grip disk, as illustrated in FIG. 10B. The cup or grip disk may have a lip around outer edges and may comprise rubber. The lipped cup or grip disk may prevent the pole mount 10 from sliding laterally. A lower portion of a sheet of material may be positioned between a bottom of the foot 80 and the cup or grip disk, for holding a lower portion of the sheet in place.

Figure 3:
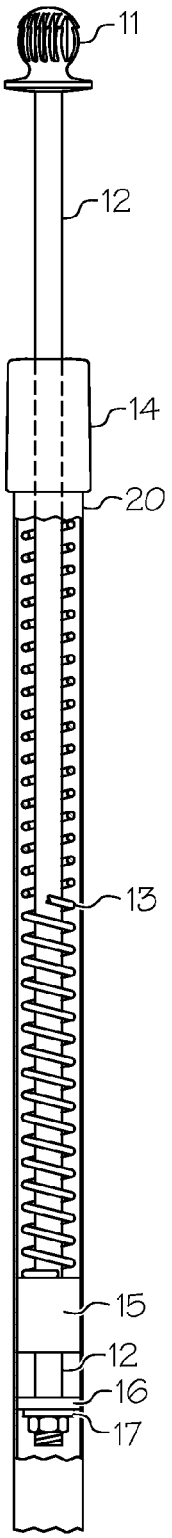
FIG. 3 is a sectional assembled side view of the compression mechanism of upper portion of the pole mount of FIG. 1 in accordance with embodiments of the present inventive concepts.
Figure 3A:
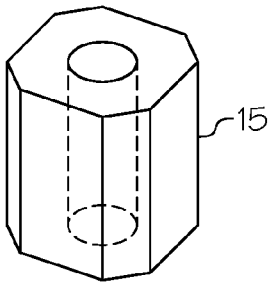
FIG. 3A is a perspective view of an anchor of FIG. 3 in accordance with embodiments of the present inventive concepts.

FIG. 3 is a sectional assembled side view of the compression mechanism of upper portion of the pole mount of FIG. 1 in accordance with embodiments of the present inventive concepts. Referring to FIG. 3, a coarse adjustment mechanism is illustrated. The rod 12, for example including a universal joint ball 11, includes a longitudinally extending body that extends through a top end of the innermost pole segment 20 and is retained by an anchor 15. FIG. 3A is a perspective view of the anchor 15 of FIG. 3 in accordance with embodiments of the present inventive concepts. In the present example embodiment, the anchor 15 has an octagonal cross-section to match the similar-shaped cross section of the interior of the innermost pole segment 20 to which the anchor is mounted. Other suitably configured shapes and cross-sections of the innermost pole segment 20 and anchor 15 are possible and equally applicable to the embodiments of the present inventive concepts.

A, compression mechanism, in this case a spring 13 is coupled between the cap 14 and the anchor 15 around an exterior of the rod 12. That is, the rod 12 passes through a longitudinal opening in the spring 13. The anchor and cap 14 may have, for example, a square or rectangular outer profile; however, the present inventive concepts are not limited thereto. In some embodiments, the bottom surface of the ball joint 11 rests on top of, and comes in contact with, cap 14 before the spring 13 becomes fully compressed.

The rod 12 is outwardly biased. Biasing of the rod 12 may be applied, for example, by the compression mechanism or spring 13 that resides in an interior portion of the innermost pole 20. When the rod 12 is pressed in a longitudinal direction into the innermost pole 20, the spring 13 operates to bias the rod 12 in an opposite, outward direction. In this manner, the pole 20 and rod 12, when compressed and mounted between two surfaces, for example between a floor and a ceiling of a room, are outwardly biased toward the floor and ceiling, which secures the pole mount 10 in place.

The rod 12 extends from the head end of the pole mount 10 and travels in a direction along the longitudinal axis of the pole 20 relative to the anchor 15 position within the pole 20. The rod 12 and anchor 15 operate to prevent the rod 12 from being released from the upper end of the innermost pole 20. A stop including washer 16 and nut 17 in the region of the first end of the rod 12 travels in relative motion with the head in the direction along the longitudinal axis of the pole. The stop interfaces with the anchor 15 to limit the outward extension of the rod 12 in the outward direction. In some embodiments, the rod 12 glides freely through the cap 14. In some embodiments, the anchor 15 may be positioned entirely within the innermost segment of the pole 20.

The anchor 15 mounts within the innermost pole 20 such that its position is longitudinally fixed within the innermost pole 20. In some embodiments, the anchor 22 is placed at an appropriate position within the innermost pole 20, and near an upper end of the innermost pole 20, and the outer surface of the innermost pole 20 is dimpled, for example using a punch tool, such that the anchor 15 is pinched between the dimples and thereby secured in place within the innermost pole 20.

The rod 12 slides freely through the anchor 15 and includes the stop, namely, in this embodiment, washer 16 and nut 17, at its first end which interface with the anchor 15 to prevent full release of the rod 12 from the pole 20. The spring 13, supported at one end by the anchor 15, when under compression, exerts an outward biasing force on the rod 12, while at the same time, anchor 15, interfacing with the washer 16 and nut 17, prevents release of the rod 12 from the innermost pole 20.

When an inwardly directed force is exerted on the rod 12, the rod 12 is urged in a direction toward the anchor 15 within the innermost pole 20 and the spring 13 is compressed between spring seats on the bodies of the anchor 15 and the cap 14. The rod 12 slides freely through the anchor 15 to allow for travel of the rod 12 within the pole 20. When the inward force is released, the compression of the spring 13 operates to exert an outwardly directed force on the rod 12, extending the body of rod 12 in a direction outwardly oriented relative to the innermost pole segment 20. In some embodiments, a washer 16 and nut 17 or other physical feature of the rod 12 prevent the rod 12 from being released from the end of the innermost pole 20, thus limiting the outward travel of the rod 12.

In some embodiments, the anchor 15 is retained and secured longitudinally in place within the pole 20 by dimpling the body of the innermost pole 20 into the body of the anchor 15. Alternatively, the anchor 15 may be mechanically riveted, chemically bonded, or otherwise mounted in place within the interior of the pole. In some embodiments, the mechanism used to secure the anchor within an interior portion of the innermost pole 20 does not interfere with the extension and compression of the innermost pole 20 relative to the intermediate pole 30 or outermost pole 40.

Figure 4:
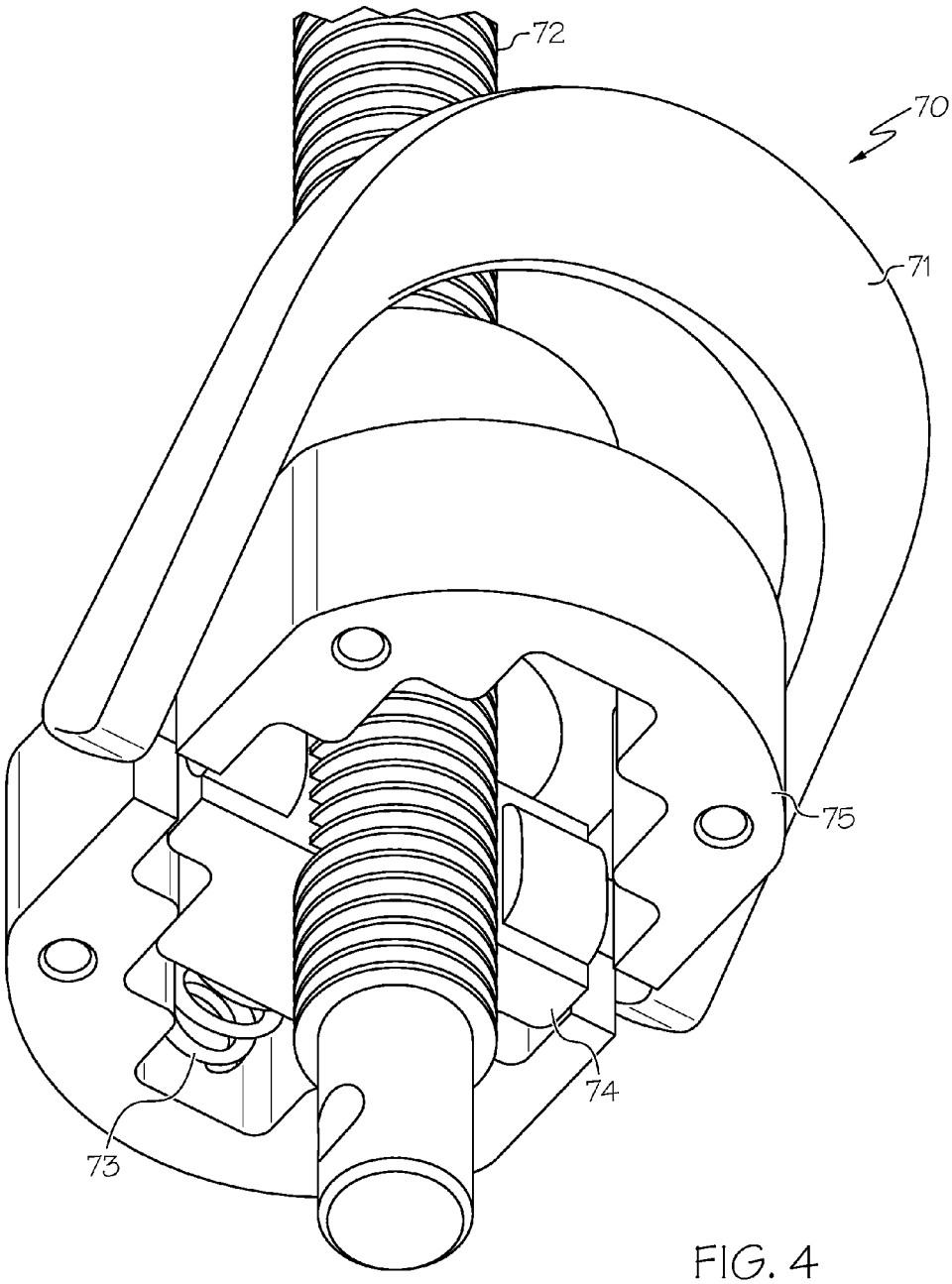
FIG. 4 is a perspective view of an embodiment of a fine adjustment mechanism of the pole mount of FIG. 1 in accordance with embodiments of the present inventive concepts.
Figure 5A:
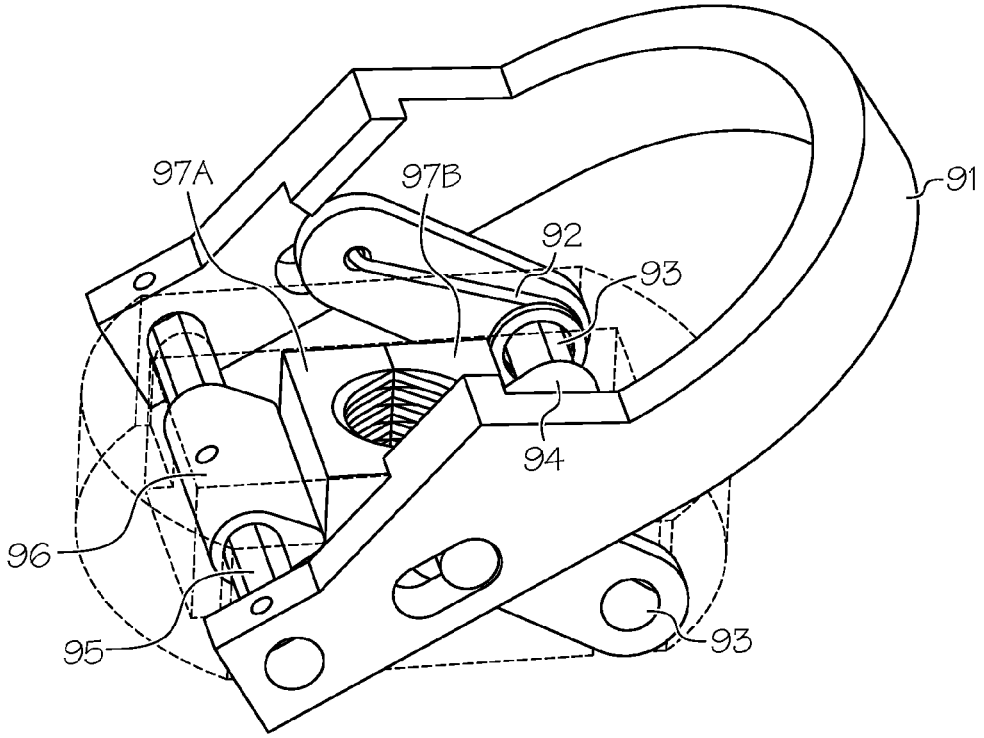
FIG. 5A is a perspective view and FIG. 5B is a cross-sectional view of an embodiment of a fine adjustment mechanism of the pole mount of FIG. 1 in a locked position in accordance with embodiments of the present inventive concepts.
Figure 5B:
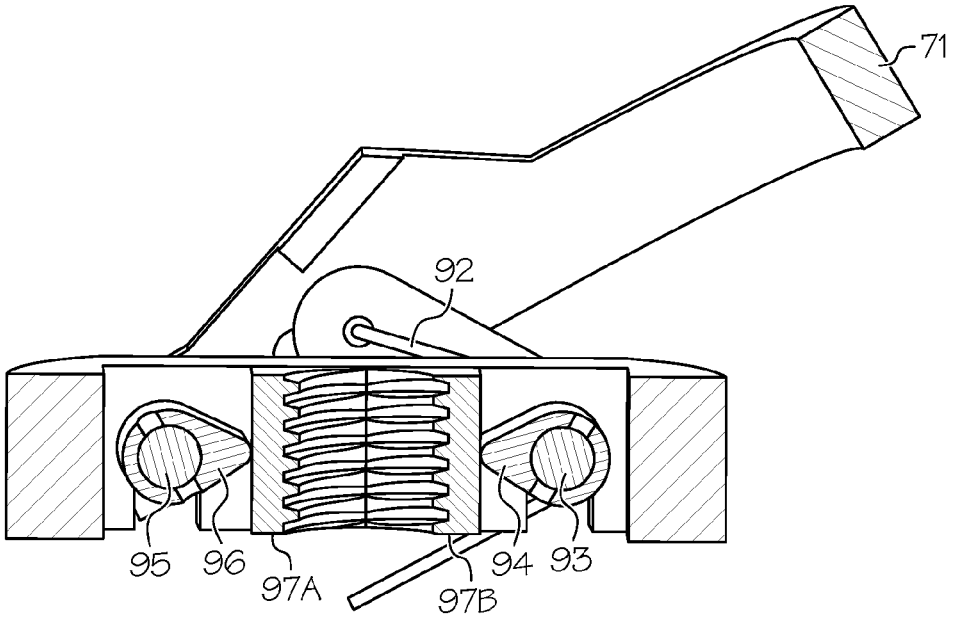
Figure 5C:
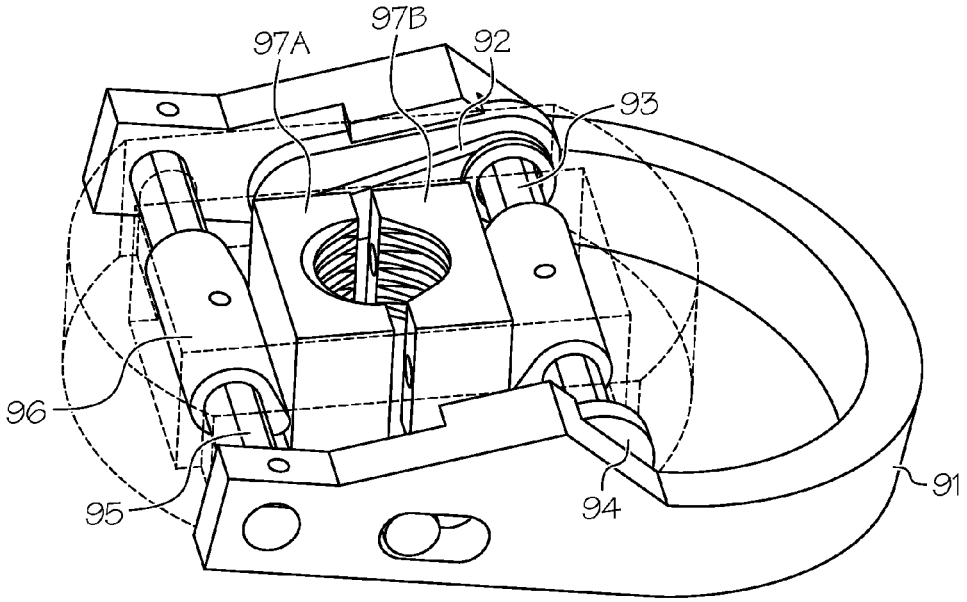
FIG. 5C is a perspective view and FIG. 5D is a cross-sectional view of the fine adjustment mechanism of FIGS. 5A and 5B in an unlocked position in accordance with embodiments of the present inventive concepts.
Figure 5D:
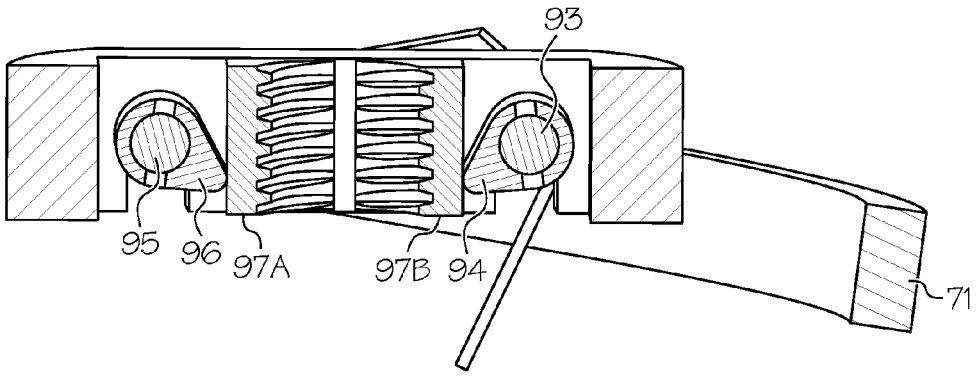

FIG. 4 is a perspective view of an example embodiment of a fine adjustment mechanism of the pole mount of FIG. 1 in accordance with embodiments of the present inventive concepts. FIG. 5A is a perspective view and FIG. 5B is a cross-sectional view of the fine adjustment mechanism of the pole mount of FIG. 1 in a locked position in accordance with embodiments of the present inventive concepts. FIG. 5C is a perspective view and FIG. 5D is a cross-sectional view of the fine adjustment mechanism of the pole mount of FIG. 1 in an unlocked position in accordance with embodiments of the present inventive concepts.

In some embodiments, the fine adjustment mechanism 70 includes a pedal and thread quick release mechanism at the foot end of the outermost pole segment 40. The fine adjustment mechanism provides micro-adjustment of the distance between the foot 80 and the foot end of the outermost pole segment 40.

Referring to FIG. 4, an embodiment of the fine adjustment mechanism 70 is illustrated. In some embodiments, the fine adjustment mechanism 70 comprises a pedal and thread, quick-release mechanism. In the present example embodiment, the fine adjustment mechanism 70 of FIG. 4 is fixed to the foot end of the outermost pole segment. A threaded rod 72 extends from an interior portion of the outermost pole 40 to an exterior portion of the outermost pole 40 at the foot end of the pole 10. The threaded rod 72 is coupled to foot 80 at, for example, a pivot joint 82 (see FIGS. 1A and 1C). A base 75 of the fine adjustment mechanism 70 includes a pedal 71, a spring 73 and a mating threaded portion 74 that mates with the threads of the threaded rod 72. When the pedal 71 is engaged, the mated threaded portion 74 is pulled back from the threaded rod 72 and pushed against spring 73 such that the threads are entirely disengaged and the threaded rod may be freely moved relative to the base 75. When the pedal 71 is released, the spring urges the mated threaded portion 74 against the threaded rod 72, locking the threads into place. In this position, the threaded rod may 72 be freely rotated relative to the base 75 but is prevented from rapid longitudinal re-positioning relative to the base 75.

FIG. 5A is a perspective view and FIG. 5B is a cross-sectional view of an embodiment of a fine adjustment mechanism of the pole mount of FIG. 1 in an engaged and locked position in accordance with embodiments of the present inventive concepts. FIG. 5C is a perspective view and FIG. 5D is a cross-sectional view of the fine adjustment mechanism of FIGS. 5A and 5B in a disengaged and unlocked position in accordance with embodiments of the present inventive concepts.

Referring to FIGS. 5A-5D, an embodiment of the fine adjustment mechanism 70 is illustrated. In the present embodiment, the fine adjustment mechanism comprises a pedal and threaded quick-release mechanism. The fine adjustment mechanism 70 of the embodiment of FIGS. 5A-5D utilizes a cam configuration rather than a spring, as in the embodiment illustrated in FIG. 4. A threaded rod 72 extends from an interior portion of the outermost pole 40 to an exterior portion of the outermost pole 40 at the foot end of the pole 10 in a manner similar to the embodiment illustrated in connection with FIG. 4. The threaded rod 72 is coupled to the foot 80 at, for example, a pivot joint 82 (see, for example, FIGS. 1A, 1B). The present embodiment of FIGS. 5A-5D includes a pedal 91, first and second mated threaded portions 97A and 97B, tabs 94 and 96, rod 95, rods 93 and spring 92. When a pedal 91 is engaged, the mated threaded portions 97A and 97B are released from engagement with the threaded rod 72. The mated threaded portions 97A and 97B are released from the threaded rod 72 in response to the rods 93 and 95 being pulled apart from each other as the tabs 96 drop in response to the pedal 91. When the pedal 91 is disengaged, the tabs 94 and 96 are pulled back up by rods 93 and 95, respectively, which pushes the mated threaded portions 97A and 97B against the threaded rod 72, engaging the threads.

In this manner, when mounting the pole mount 10 between a floor and ceiling of a room, the pole mount can be brought into general position and adjusted in length using the telescoping pole segments 20, 30, 40 and locking mechanisms 50, 60 for coarse adjustment. The underside of the head 200 and the lower flange of the universal joint ball 11 can be fully compressed against the outward force of the compression mechanism 13 so that it is caused to "bottom out" against the cap 14 of the innermost extension pole 20 by pushing the pole mount 10 against the ceiling causing the rod 12 to be pushed into the innermost pole 20. When the underside portion of the universal joint ball 11 abuts the cap 14 of the innermost pole 20, the plunger mechanism is considered to be "bottomed out", meaning that there is little further room for play or compression in the pole mount 10. At this time, the outermost pole segment 40, and the other pole segments 20, 30 along with it, can be rotated in a first direction relative to the foot 80, causing the outermost pole segment 40 to travel further up the threads of the threaded rod 72 relative to the foot 80. This, in turn, places the pole mount under further compression, applying additional longitudinal compression, since the distance between the underside of the foot 80 and the top of the head 200 is incrementally lengthened between the floor and ceiling. In some embodiments, a grip may be provided along an outer portion of the outermost pole segment 40 to aid in the rotation of the pole mount 10 relative to the foot 80. To later disengage the pole mount 10, the pole segments can be rotated in a second direction, opposite the first direction, relative to the foot 80, causing the distance between the underside of the foot 80 and the top of the head 200 to be incrementally decreased between the floor and ceiling. When the initial pressure due to the rotational adjustment is released, engagement of the pedal 71 causes the mating threaded portions 74 to become disengaged, allowing the foot 80 and threaded rod 72 to float freely relative to the outermost pole segment 40. In some embodiments, the first direction of rotation is illustrated by arrow 84A (see FIG. 1A), and the second direction of rotation is illustrated by arrow 84B (see FIG. 1A). In other embodiments, the first and second directions can be reversed, for example depending on the orientation of the threads of the threaded rod 72.

Figure 6A:
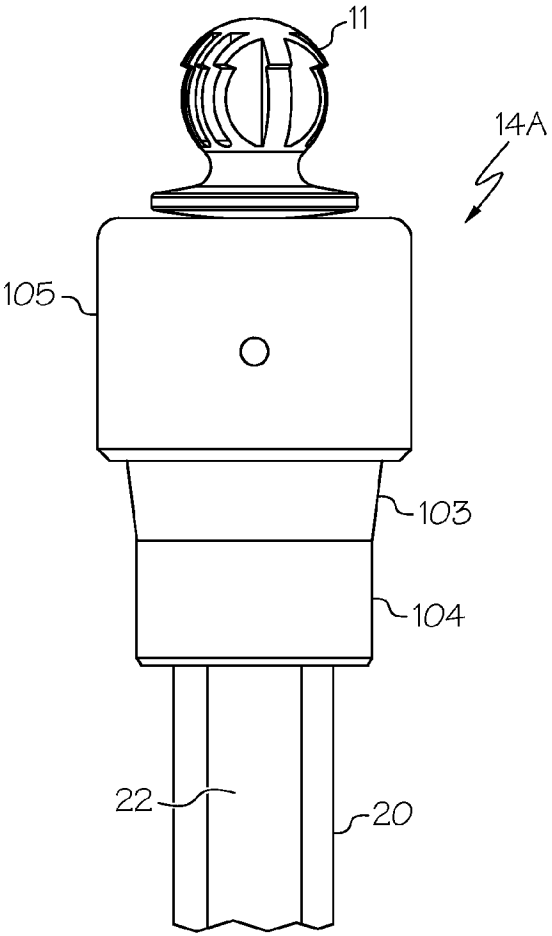
FIG. 6A is a side view of compression meter of a pole mount in an uncompressed state in accordance with embodiments of the present inventive concepts.
Figure 6D:
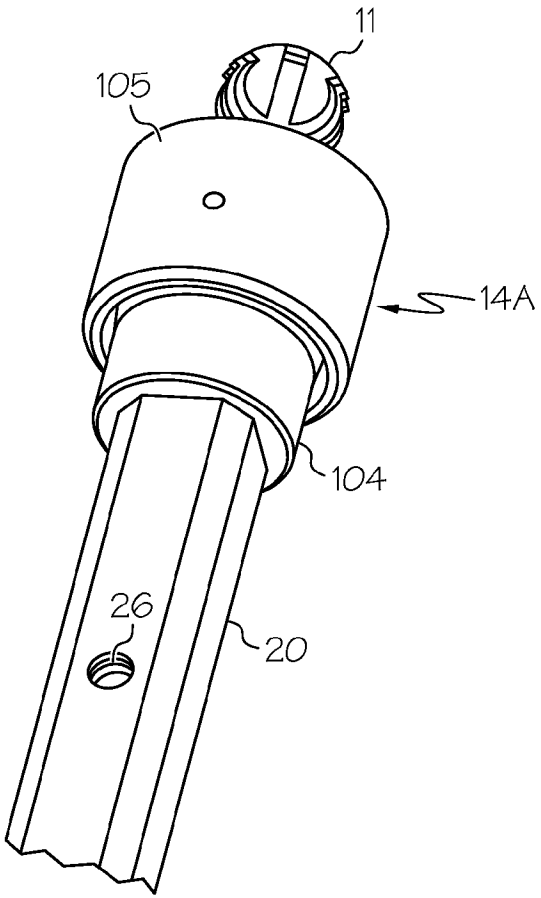
FIG. 6D is a perspective view of the compression meter of the pole mount of FIG. 6A in a compressed state in accordance with embodiments of the present inventive concepts.
Figure 6C:
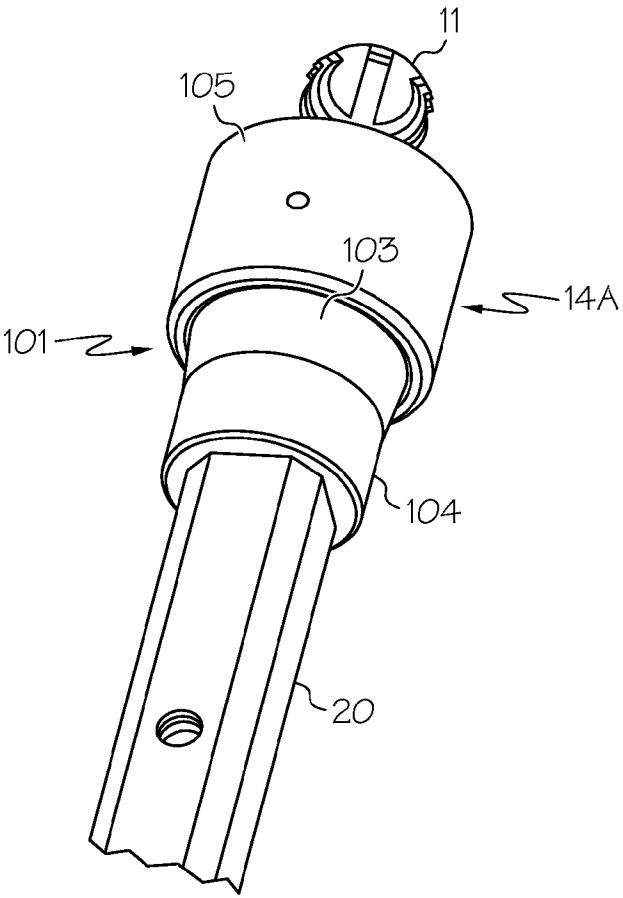
FIG. 6C is a perspective view of the compression meter of the pole mount of FIG. 6A in an uncompressed state in accordance with embodiments of the present inventive concepts.
Figure 6F:
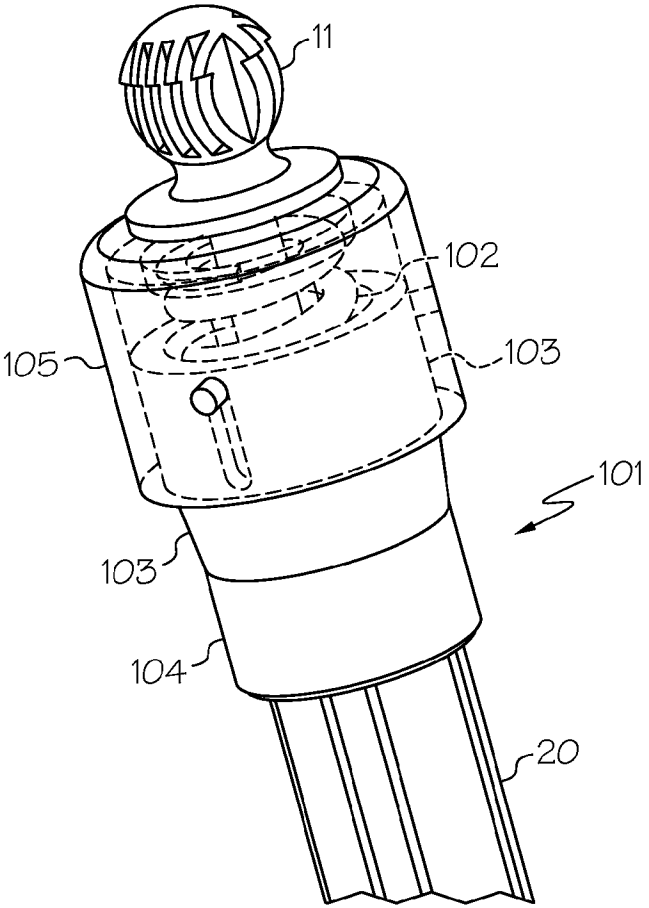
FIGS. 6E and 6F are perspective views of the compression meter of the pole mount of FIG. 6A in accordance with embodiments of the present inventive concepts.
Figure 6E:
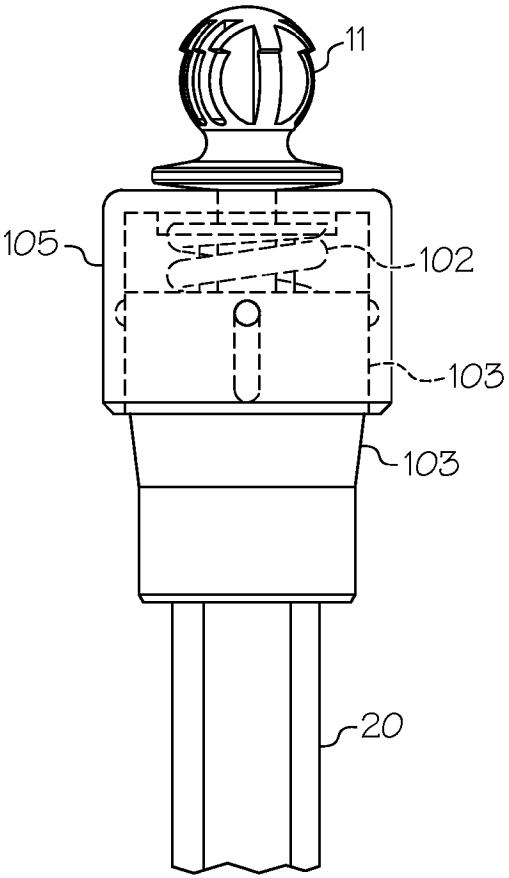

FIG. 6A is a side view of compression meter of a pole mount in an uncompressed state in accordance with embodiments of the present inventive concepts. FIG. 6B is a side view of the compression meter of the pole mount of FIG. 6A in a compressed state in accordance with embodiments of the present inventive concepts. FIG. 6C is a perspective view of the compression meter of the pole mount of FIG. 6A in an uncompressed state in accordance with embodiments of the present inventive concepts. FIG. 6D is a perspective view of the compression meter of the pole mount of FIG. 6A in a compressed state in accordance with embodiments of the present inventive concepts. FIGS. 6E and 6F are perspective views of the compression meter of the pole mount of FIG. 6A in accordance with embodiments of the present inventive concepts.

As the fine adjustment mechanism provides for micro-adjustment of the amount of force imparted by the pole to the ceiling and floor, it is desired that a maximum intended force not be exceeded. Otherwise, damage to the ceiling, floor, or pole system can occur. In some embodiments, the pole mount 10 is configured to withstand approximately 185 lbs. of inward compressive, longitudinal pressure depending on the configuration. In some embodiments, the pole mount 10 is configured to withstand greater or less than approximately 185 lbs. of inward longitudinal pressure depending on the configuration. In some embodiments, the pole mount 10 is configured to withstand approximately 250 lbs. of inward longitudinal pressure depending on the configuration.

In some embodiments the cap 14 applied to an upper portion of the innermost pole segment 20 comprises a compression meter or pressure gauge 14A. The compression meter 14A indicates when a maximum compression force is exceeded. In some embodiments, the compression meter 14A may include a spring 102 (see FIGS. 6E and 6F) and a visual indicator 101 such that when the spring 102 of the compression meter 14A is compressed to a predefined position, the visual indicator 101 indicates that the spring 102 is at the predefined position and, thus, a maximum longitudinal force is exceeded. In some embodiments, the compression meter 14A the maximum force is 185 lbs. In such an embodiment, the spring 102 can be selected to have certain characteristics that indicate that a known compressive force is exerted on the pole system.

In some embodiments, the visual indicator 101 includes a cap 105 and a bottom portion having a smaller diameter than the cap portion 105 which extends into the cap portion 105. The bottom portion includes a first portion 103 and a second portion 104. The spring 102 is formed within cap 105 around rod 12 into a top surface of the first portion 103. In some embodiments, the first portion includes a portion that is a color different from the pole, for example, red. In an uncompressed state, the red portion of the first portion 103 is exterior to the cap 105.

As illustrated in FIGS. 6A-6D, as the fine adjustment mechanism 70 is used to adjust the length of the pole increasing the longitudinal force exerted between the floor and ceiling, at a certain amount of force, the compression meter 14A begins to undergo compression; that is, spring 102 is compressed between the cap 105 and the first and second portions 103 and 104. When the red portion of the first portion 103 is no longer visible, as illustrated in FIGS. 6B and 6D, this provides an indication that the spring 102 of the compression meter 14A is compressed to a predefined point. That is, the visual indicator 101 indicates that the spring 102 is at the predefined compression point, and, thus, a maximum compressive force has been exceeded.

Figure 7A:
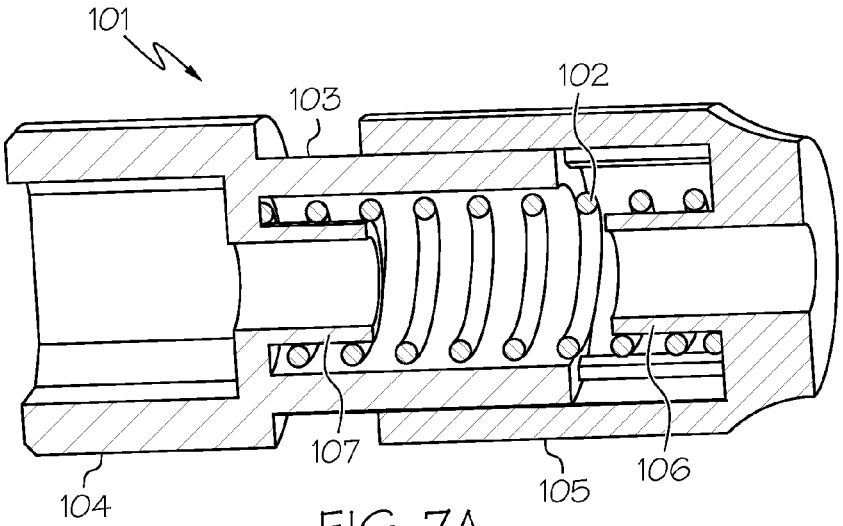
FIG. 7A is a cross-sectional view of the compression meter of the pole mount of FIG. 6A in accordance with embodiments of the present inventive concepts.
Figure 7B:
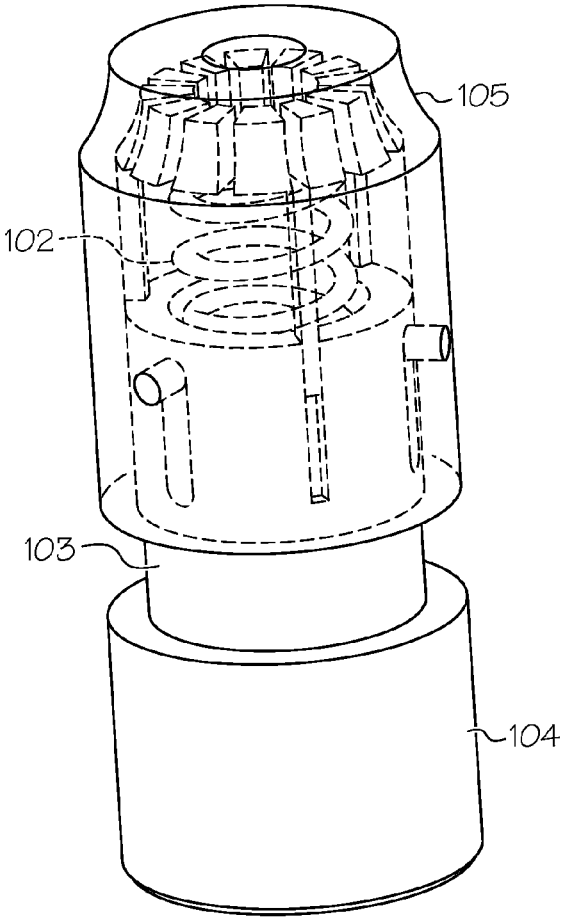
FIG. 7B is perspective view of the compression meter of the pole mount of FIG. 7A in accordance with embodiments of the present inventive concepts.
Figure 7C:
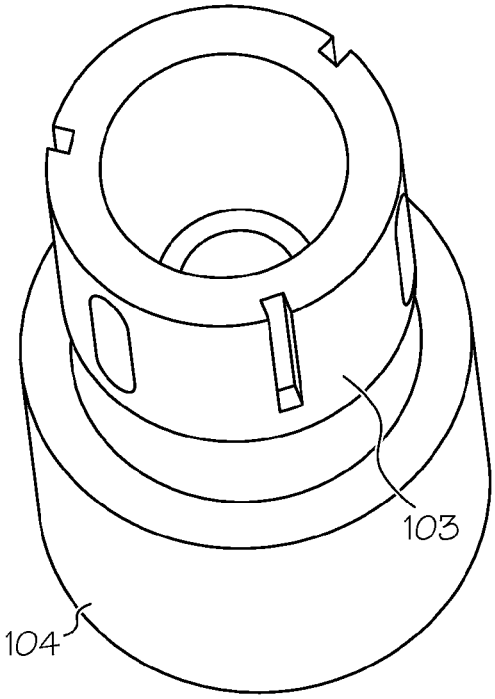
FIG. 7C is a perspective view of a visual indicator portion of the compression meter of the pole mount of FIG. 7A in accordance with embodiments of the present inventive concepts.
Figure 7D:
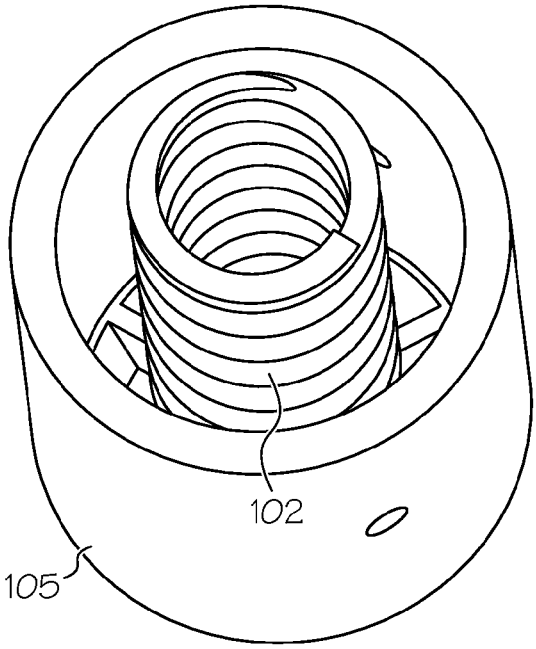
FIG. 7D is a perspective view of a compression portion of the compression meter of the pole mount of FIG. 7A in accordance with embodiments of the present inventive concepts.
Figure 7E:
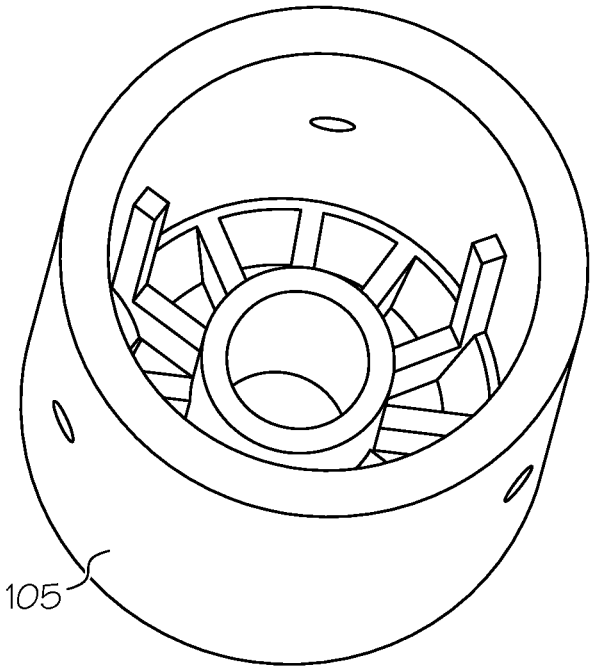
FIG. 7E is a perspective view of a base of the compression portion of the compression meter of the pole mount of FIG. 7D in accordance with embodiments of the present inventive concepts.
Figure 7F:
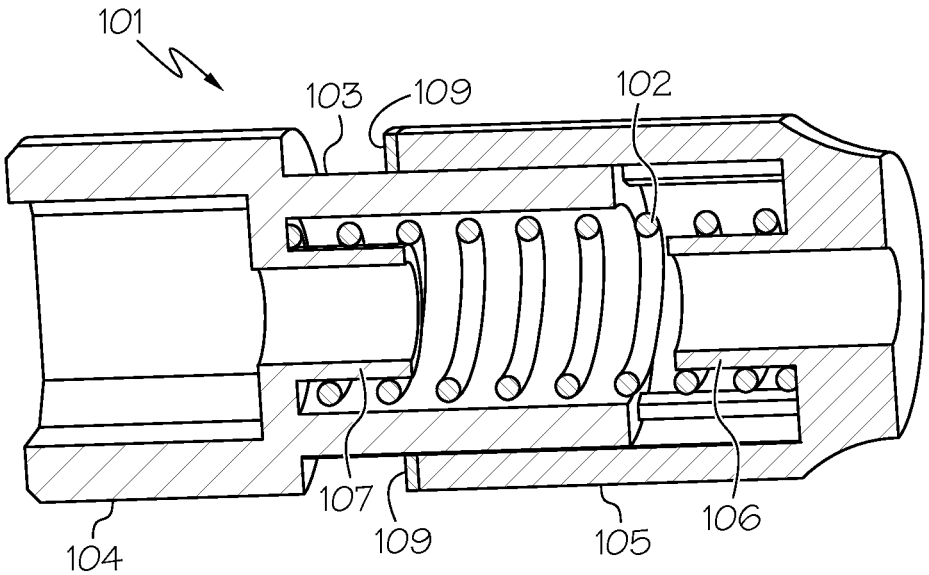
FIG. 7F is a cross-sectional view of the compression meter of the pole mount of FIG. 6A in accordance with embodiments of the present inventive concepts.

FIG. 7A is a cross-sectional view of the compression meter of the pole mount of FIG. 1A in accordance with other embodiments of the present inventive concepts. FIG. 7B is perspective view of the compression meter of the pole mount of FIG. 1A in accordance with other embodiments of the present inventive concepts. FIG. 7C is a perspective view of a visual indicator portion of the compression meter of the pole mount of FIG. 1A in accordance with other embodiments of the present inventive concepts. FIG. 7D is a perspective view of a compression portion of the compression meter of the pole mount of FIG. 1A in accordance with other embodiments of the present inventive concepts. FIG. 7E is a perspective view of a base of the compression portion of the compression meter of the pole mount of FIG. 7D in accordance with other embodiments of the present inventive concepts. FIG. 7F is a cross-sectional view of the compression meter of the pole mount of FIG. 6A in accordance with embodiments of the present inventive concepts.

As illustrated in FIGS. 7A-7E, the first portion 103 of the bottom portion of the visual indicator may have a smaller diameter than the second portion 104. In some embodiments, the second portion 104 may have the same diameter as the cap 105. In some embodiments, the bottom rim (see rim 109 of FIG. 7F) of the cap 105 may also be of a different color than the pole, for example, red. In some embodiments, the cap 105 may have a tab 106, the bottom portion may have a tab 107 and the ends of the spring 102 may be seated about the tabs 106 and 107 to surround them.

Referring to FIG. 7C, the bottom portion 103, 104 of the compression meter 14A includes first portion 103 and second portion 104. Referring to FIG. 7D spring 102 of the compression meter 14A is illustrated as being seated on the tab in the cap 105. In FIG. 7E the cap 105 is illustrated with the spring removed.

In some embodiments, the visual indicator 101 includes a cap 105 and a bottom portion having a smaller diameter than the cap portion 105 which extends into the cap portion 105. The bottom portion includes a first portion 103 and a second portion 104. The second portion 104 may have the same diameter as the cap 105. The spring 102 is formed within cap 105 around rod 12 into a top surface of the first portion 103. The bottom of cap 105 may have a reflective material 109, for example, reflective tape, thereon, as illustrated in FIG. 7F. IN some embodiments, the reflective tape provides for greater visibility of the state of the visual indicator 101 to a user at the ground level.

In the embodiments of FIGS. 6 and 7, as the fine adjustment mechanism 70 is used to adjust the length of the pole increasing the longitudinal force exerted between the floor and ceiling, at a certain amount of force, the compression meter 14A begins to undergo compression; that is, spring 102 is compressed between the cap 105 and the first and second portions 103 and 104. When the red portion of the first portion 103 is no longer visible or partially visible, as illustrated in FIGS. 6B and 6D, or when the reflective tape 109 is no longer visible or partially visible this provides an indication that the spring 102 of the compression meter 14A is compressed to a predefined point. That is, the visual indicator 101 indicates that the spring 102 is at the predefined compression point, and, thus, a maximum compressive force has been exceeded. This can help to avoid damage to the pole, floor or ceiling or other structures between which the pole mount is mounted, for example, due to overlengthening of the pole mount between the fixed surfaces.

Although in the embodiments illustrated herein, the compression meter 14A or visual indicator 101 is depicted as a mechanical device with a visual identifier as to when a certain compressive force has been applied, in other embodiments, such devices can optionally take the form of a piezoelectric sensor, or other suitable device, that measures force applied to the system and converts the force to an electronic signal. In some embodiments, that signal can be applied to a communication device that indicates to a user information related to the force. For example, the information can indicate the actual force measurement, or indicate whether a force amount has been met or exceeded. The information can be communicated via wire to a digital readout coupled to the pole or, optionally, wirelessly to a wireless device such as a wireless phone or electronic handheld.

Figure 8A:
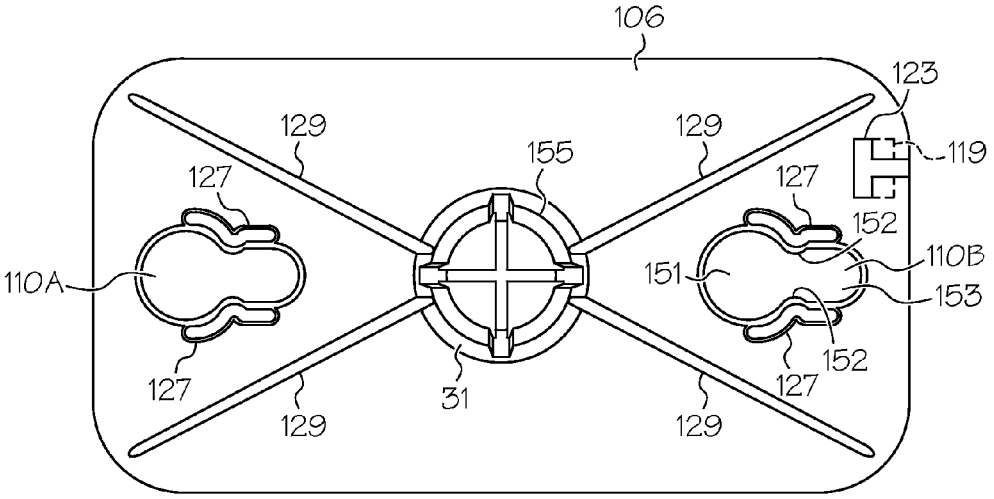
FIG. 8A is a bottom view of a head of a coupling device and FIG. 8B is a bottom view of a clip of the coupling device in accordance with embodiments of the present inventive concepts.
Figure 8B:
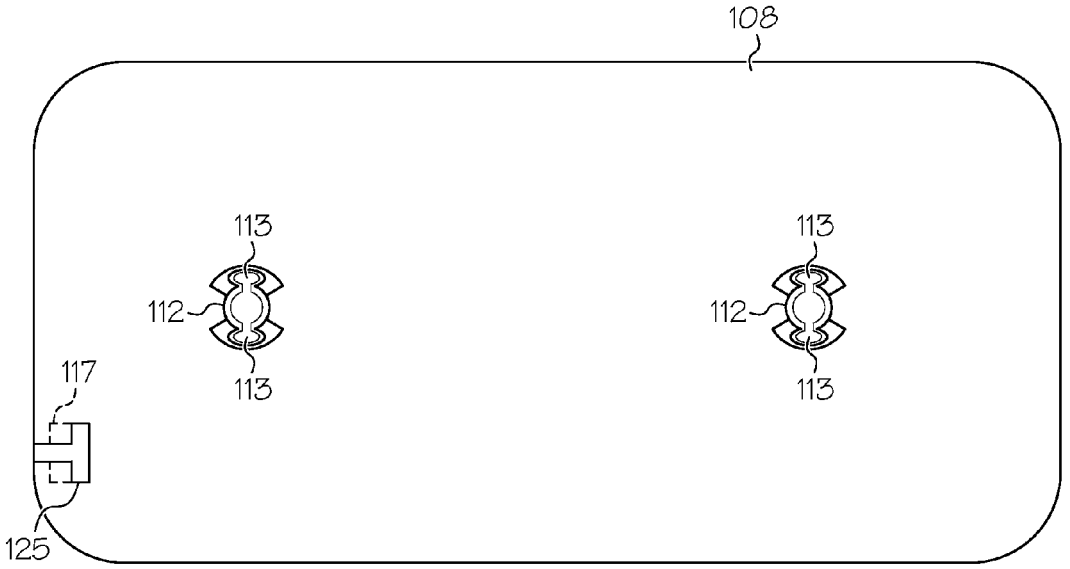
Figure 9A:
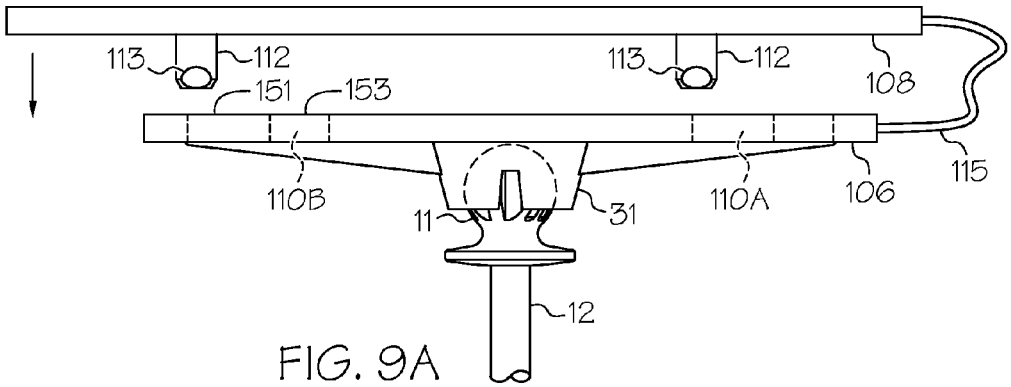
FIGS. 9A-9C are side views of the coupling device of FIGS. 8A and 8B coupled to the pole mount of FIG. 1 sequentially illustrating a process of coupling the clip to the head.
Figure 9B:
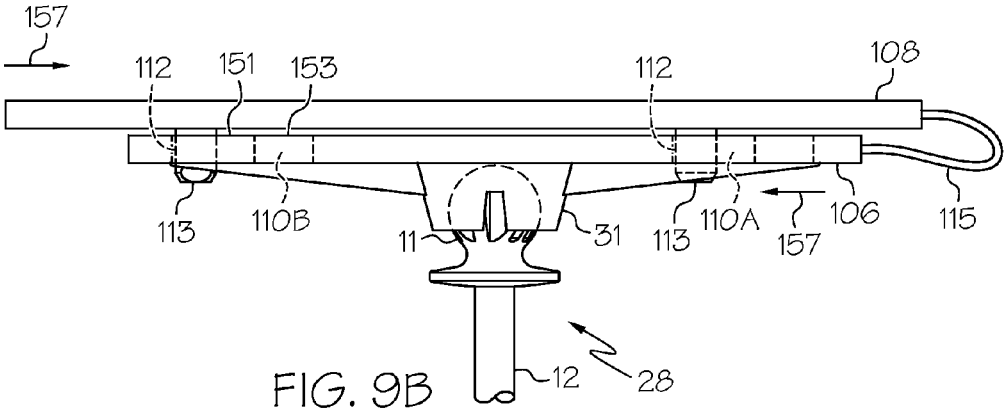
Figure 9C:
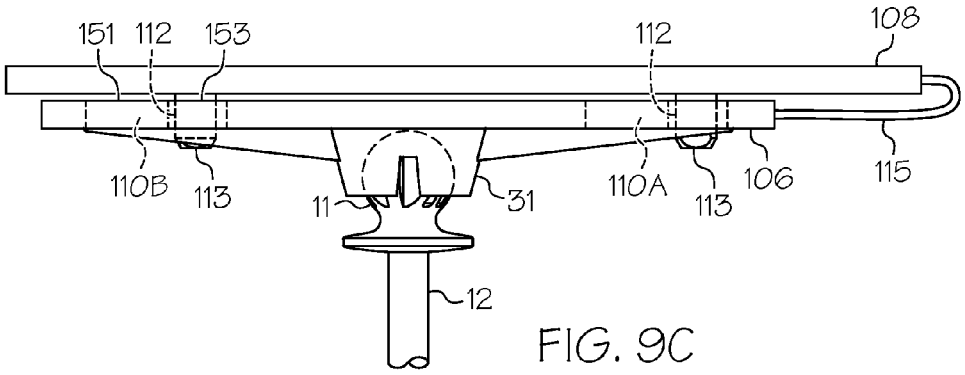

FIG. 8A is a bottom view of a head of a coupling device and FIG. 8B is a bottom view of a clip of the coupling device in accordance with embodiments of the present inventive concepts. FIGS. 9A-9C are side views of the coupling device of FIGS. 8A and 8B coupled to the pole mount of FIG. 1 sequentially illustrating a process of coupling the clip to the head. A coupling device, for example, a clip and/or a head, may be coupled to the ball joint 11 of the pole mount 10.

FIGS. 8A is a bottom view of a head and 8B is a bottom perspective view of a clip of a coupling device adapted to interface with the universal ball joint 11 of the rod 12, in accordance with the present inventive concepts. The head 106 includes a socket 31 that receives the ball 11 of the rod 12. In combination, the socket 31 and the ball 11 form a universal joint. In one embodiment, the socket 31 includes elastically deformable teeth 155 that expand around the ball 11, when inserted, to provide a snap-fit relationship. In the embodiment illustrated, the head is generally in the shape of a flat plate, and includes apertures 110A and 110B. The apertures 110A, 110B are in the shape of a relatively large keyhole 151 that extends into a relatively narrow slot 153. Flex grooves 127 are formed through the body of the head 106 spaced apart a suitable distance from sidewalls 152 of the apertures 110A, 110B. The flex grooves 127 provide the aperture sidewalls 152 with a suitable degree of flexibility. The head 106 further includes ribs 129 that extend outward from the outer walls of the teeth 155 of the universal joint socket 31. The ribs 129 provide structural integrity to the universal joint socket 31 and head 106. In some embodiments, the head 106 may further include a keyed tether slot 123.

FIG. 8B is a bottom view of the clip 108 of the present inventive concepts. The clip 108, in this example, is generally in the shape of a flat plate, and includes two pins 112 that extend from its lower surface. The pins 112 include retaining knobs or lobes 113 at their distal ends. In some embodiments, the clip 108, like the head 106, may include a keyed tether slot 125. In one embodiment, the pins 112, retaining knobs 113, and keyed tether slot 125 are configured such that the clip can be formed in a straight-pull molding process.

FIGS. 9A-9C are side views of the clip and head of FIGS. 8A and 8B sequentially illustrating the process of the clip 108 being coupled to the head 106, in accordance with the present invention. As shown in FIG. 9A, the universal joint ball 11 is inserted into the socket 31 of the head 106. In this manner, the head 106 can be rotated relative to the rod 12 and pole 20 in three degrees of freedom. The apertures 110A, 110B of the head 106 are constructed and arranged to receive the pins 112 of the clip 108. In this example, two pins are provided, however, a mating clip and head with other numbers of pins and corresponding apertures are equally applicable to the present inventive concepts. In addition, in other embodiments, the pins 112 can be attached to the head 106, and the mating apertures 110A, 110B can be provided on the clip 108, as illustrated in FIG. 9D. Also, in other embodiments, the pins 112 on one of the clip and head can be constructed and arranged to snap into mating apertures on the other of the clip and head, in a snap-fit relationship.

The clip 108 is optionally connected to the head 106 by a tether 115, which, in some applications, is desired for preventing separation of a clip from a corresponding head. The tether 115 comprises for example a rope, fastener, wire, cord, chain, strap or plastic attachment. The tether 115 may be removable from either or both of the clip 108 and head 106. Alternatively, the tether 115 may be integral with either, or both, of the clip 108 and head 106.

In FIG. 9A, the pins 112 and retaining knobs 113 of the clip 108 are positioned over the large keyholes 151 of the apertures 110A, 110B of the head 106. A curtain to be installed (not shown) is placed between the clip 108 and head 106 at this time. The pins 112 and retaining knobs 113 are moved into position near keyholes 151 of the apertures 110A, 110B of the head 108, as shown by arrow 156. In FIG. 9B, the pins 112 and retaining knobs 113 of the clip 108 are inserted into the keyholes 151 of the apertures 110A, 110B of the head 106. At this time, the curtain material is primarily positioned between the lower surface of the clip 108 and the upper surface of the head 106, with the exception of the pin 112 and aperture 110A, 110B region, in which the curtain material extends about the body of the pins 112. The clip 108 and head 106 are then pushed relative to each other in a first direction, as shown by arrows 157, so that the body of the pins 112 engage the inner sidewalls 152 of the apertures 110A, 110B of the head 106. The flex grooves 127 cause the aperture sidewalls 152 to flex about the body of the pins 112, and the clip 108 is snapped into place when the pins 112 are seated in the relatively narrow slots 153 of the apertures 110A, 110B. In FIG. 9C, the pins 112 of the clip 108 are seated in the aperture slots 153, and the retaining knobs 113 abut the lower surface of the head 106, thereby securing the clip 108 to the head 106, with the curtain material (not shown) held in position there between.

In this embodiment, the head 106 and mating clip 108 extend in a direction that is transverse to the longitudinal axis of the extension pole 20 and plunger 28. The greater the extension of the head, the larger the area of interaction between the head/clip and curtain material, and therefore the stronger the interface. Also, a larger area of interaction prevents the curtain from tearing at the head from stress due to its own weight, or from an externally applied force.

The pole mount of the present inventive concepts provides a pole mount having coarse adjustment and fine adjustment mechanisms and is strong enough to be used in commercial construction. The pole mount of the present inventive concepts may withstand increased compressive strain. In some embodiments, a visual indicator is provided for indicating the point at which a selected degree of compressive strain has been applied.

Figure 10A:
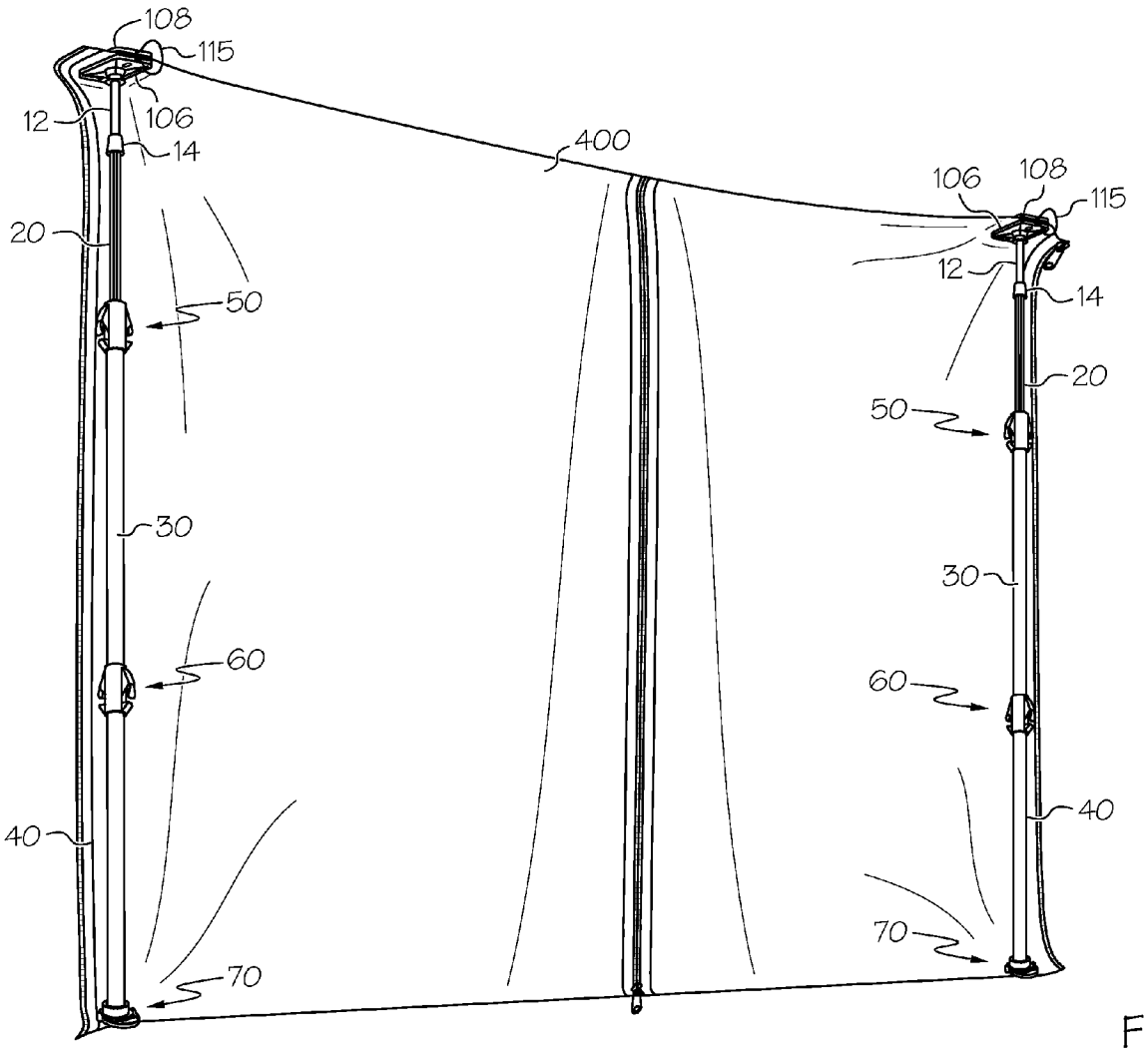
FIGS. 10A-10B are perspective views of an installed dust barrier including the pole mount of FIG. 1 in accordance with embodiments of the present inventions.
Figure 10B:
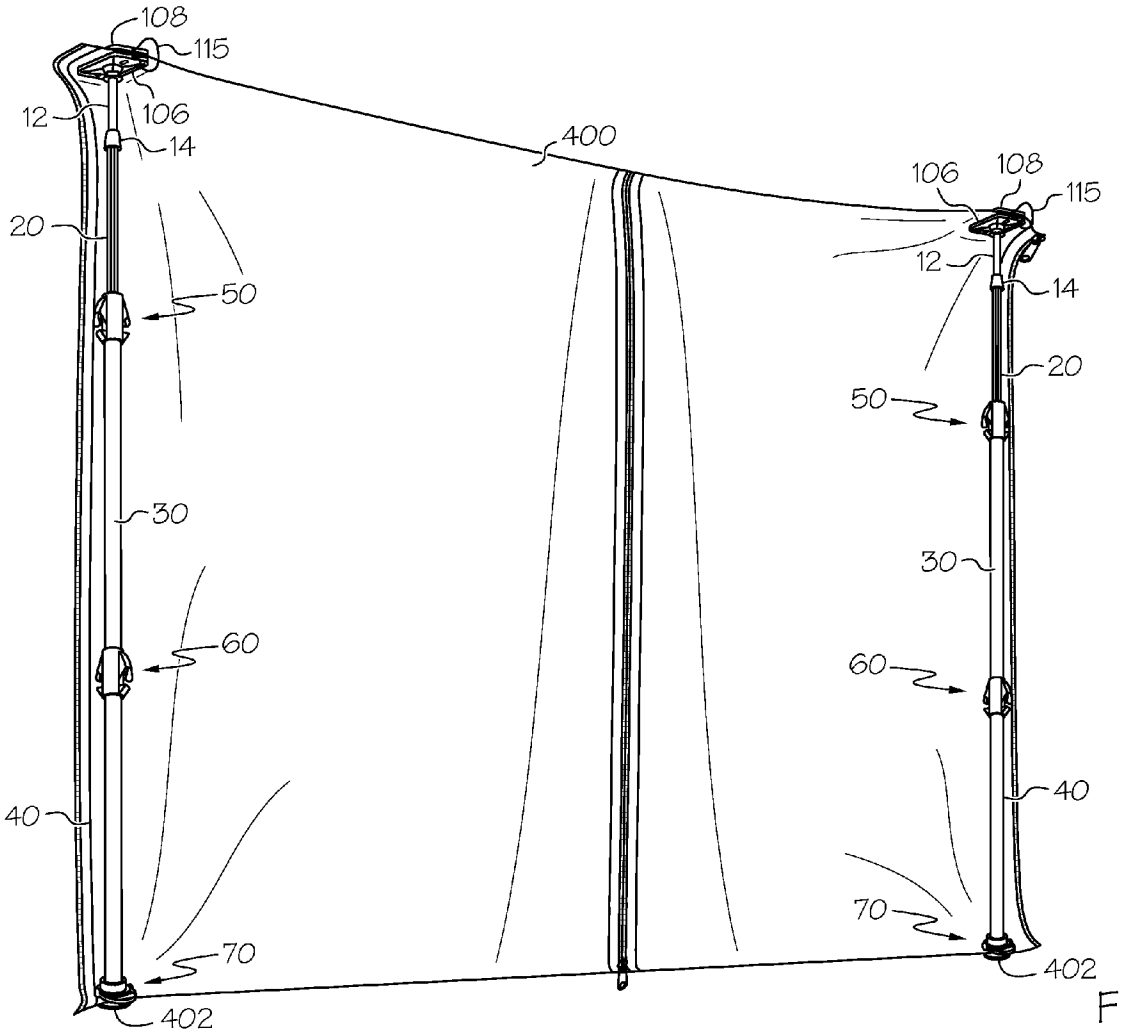

FIGS. 10A-10B are perspective views of an installed dust barrier including the pole mount of FIG. 1 in accordance with embodiments of the present inventions.

In the various installation configurations disclosed herein, a top portion of a barrier panel 400, or sheet of material, may be positioned between the head 106 and the clip 108 of the pole mount 10. This may be performed at ground level, by an installer, and, once clipped, can be raised to the ceiling and placed in approximate position. The pole mount 10 can be adjusted in length by the installer using the coarse adjustment mechanism, as illustrated in FIG. 3, so that the spring 13 in the pole mount 10 is compressed slightly when the pole mount 10 is installed between the ceiling and floor. Once installed, the foot 80 may be positioned over a bottom portion of the barrier panel 400. The foot 400 and bottom portion of the barrier may, in turn, be positioned over an anti-skid GripDisk™, grip or cup 402, as illustrated in FIG. 10B, for gripping the surface of the floor with the barrier panel 400 therebetween. Starting at one end of the barrier panels 400, the poles are lifted into position, one-by-one, secured between the floor and ceiling, and then placed so that the foot 80 of the pole rests on the barrier panel 400 directly over its corresponding, optional, GripDisk™, grip or cup. In this manner, the barrier panels 400 are held vertically in place. By positioning the lower portion of the barrier panel 400 between the foot of the pole and the floor, the panels are held securely in place.

The fine adjustment mechanism 70 may then be used to provide micro-adjustment of the pole mount 10. The length of the pole may be adjusted using the fine adjustment mechanism 70 until the visual indicator 101 of the compression meter 14A indicates that a predetermined longitudinally oriented compression force has been applied to the pole system.

In embodiments of the present inventive concepts described herein, the term "floor" and "ceiling" are selected as convenient examples of first and second surfaces between which the pole mount system 10 can be mounted. However, the system is equally applicable to operation between any of first and second surfaces including floor, ceiling, walls, or other structures of a room of a building or an outdoor space, a truck, a tractor trailer, a shipping container, and the like.

While the present inventive concepts have been particularly shown and described above with reference to example embodiments thereof, it will be understood by those of ordinary skill in the art, that various changes in form and detail can be made without departing from the spirit and scope of the present inventive concepts described and defined by the following claims.

What is claimed is:

1. A pole mount, comprising:
- a telescoping, length-adjustable pole having a head end and a foot end;
- a coarse length-adjustment mechanism; and
- a fine length-adjustment mechanism,
- wherein the fine length-adjustment mechanism is proximal to the foot end of the pole and the coarse length-adjustment mechanism is at an end of a segment of the telescoping pole nearest the head end of the pole,
- wherein the fine length-adjustment mechanism comprises:
  - a quick-release mechanism that engages and disengages a female threaded portion having female threads, the quick-release mechanism fixedly coupled to the foot end of the pole; and
  - a threaded rod having a male thread corresponding to the female thread, such that when the quick release mechanism is in an engaged position the threaded rod slides freely through the female threaded portion and such that when the quick-release mechanism is in a disengaged position, the male thread and female threaded portion are engaged and can be rotated relative to each other,
  - wherein the quick release mechanism further comprises a pedal that causes the female threaded portion to engage and disengage the threaded rod, and
  - wherein, when the pedal is engaged, the pedal pivots relative to the threaded rod to release the female threaded portion from engagement with the threaded rod, and, when the pedal is released, the pedal pivots relative to the threaded rod to engage the male thread and the female threaded portion.

2. The pole mount of claim 1, wherein the pole comprises a plurality of telescoping segments.

3. The pole mount of claim 2, wherein the pole mount further comprises a foot, the fine length-adjustment mechanism being positioned between the foot and an outermost segment of the plurality of telescoping segments.

4. The pole mount of claim 1, wherein the coarse length-adjustment mechanism comprises an anchor secured to and within a narrowest segment of the pole, at a position proximal to the head end of the pole.

5. The pole mount of claim 4, wherein the coarse length-adjustment mechanism further comprises a head extending from the head end of the pole and traveling in a direction along the longitudinal axis of the pole relative to the anchor position within the pole.

6. The pole mount of claim 5, wherein the head comprises:
- a first portion, a portion of the first portion extending into an interior of the pole; and
- a second portion that extends transverse to the first portion; and a compression mechanism that biases the position of the head in an outward direction away from the anchor.

7. The pole mount of claim 6, wherein the anchor is constructed and arranged to limit outward extension of the head in the outward direction, and wherein the head comprises a stop that travels in relative motion with the head in the direction along the longitudinal axis of the pole, wherein the stop interfaces with the anchor to limit the outward extension of the head in the outward direction.

8. The pole mount of claim 1 further comprising:

a foot coupled to an end of the threaded rod; and a pivot between the foot and threaded rod so that the foot and threaded rod pivot relative to each other.

9. The pole mount of claim 1 wherein the quick release mechanism further comprises the pedal that engages and disengages the female threaded portion.

10. The pole mount of claim 1, wherein the fine adjustment mechanism provides micro-adjustment of the pole length.

11. The pole mount of claim 1, wherein the fine adjustment mechanism provides for fine control of the amount of outward extension of the foot relative to a foot end of a widest segment of the pole.

12. The pole mount of claim 1 further comprising a compression meter indicating when a maximum longitudinal force is exceeded.

13. The pole mount of claim 5, further comprising a compression meter indicating when a maximum longitudinal force is exceeded, wherein the maximum longitudinal force is applied when the head is in a position where a lower surface of a portion of the head is in direct contact with an upper surface of a head end of the narrowest segment of the pole.

14. The pole mount of claim 12, wherein the compression meter comprises a spring and a visual indicator such that, when the spring of the compression meter is compressed to a predefined point, the visual indicator indicates that a predetermined longitudinally oriented compression force has been applied to the pole system.

15. The pole mount of claim 14, wherein the visual indicator comprises a painted ring that becomes obstructed when the maximum force is applied.

16. The pole mount of claim 14, wherein the visual indicator comprises a reflective material that becomes obstructed when the maximum force is applied.

17. The pole mount of claim 1, wherein the pole comprises a plurality of telescoping segments and locking mechanisms between pole segments for locking positions of adjacent segments relative to each other.

18. The pole of mount of claim 17, wherein at least one of the pole segments comprises at least one flat surface configured to mate with a flat inner surface of the locking mechanism.

19. A method of installing the pole mount of claim 14, comprising:

coupling a curtain to the head end of the pole;

mounting the pole such that the coarse adjustment mechanism adjusts the length of the pole;

adjusting the length of the pole using the fine adjustment mechanism until the visual indicator indicates that a predetermined longitudinally oriented compression force has been applied to the pole system.

20. A pole mount, comprising:

a telescoping, length-adjustable pole having a head end and a foot end;

a coarse length-adjustment mechanism, wherein the coarse length-adjustment mechanism comprises:

an anchor secured to and within a narrowest segment of the pole, at a position proximal to the head end of the pole;

a head extending from the head end of the pole and traveling in a direction along the longitudinal axis of the pole relative to the anchor position within the pole; and a compression mechanism that biases the position of the head in an outward direction away from the anchor, wherein the anchor is constructed and arranged to limit outward extension of the head in the outward direction, and wherein the head comprises a stop that travels in relative motion with the head in the direction along the longitudinal axis of the pole, wherein the stop interfaces with the anchor to limit the outward extension of the head in the outward direction;

a fine length-adjustment mechanism, wherein the fine length-adjustment mechanism is proximal to the foot end of the pole and the coarse length-adjustment mechanism is at an end of a segment of the telescoping pole nearest the head end of the pole, the fine length-adjustment mechanism comprising:

a quick-release mechanism that engages and disengages a female threaded portion having female threads, the quick-release mechanism fixedly coupled to a foot end of the pole; and a threaded rod having a male thread corresponding to the female thread, such that when the quick release mechanism is in an engaged position the threaded rod slides freely through the female threaded portion and such that when the quick-release mechanism is in a disengaged position, the male thread and female threaded portion are engaged and can be rotated relative to each other, wherein the quick release mechanism further comprises a pedal that causes the female threaded portion to engage and disengage the threaded rod, and wherein, when the pedal is engaged, the pedal pivots relative to the threaded rod to release the female threaded portion from engagement with the threaded rod, and, when the pedal is released, the pedal pivots relative to the threaded rod to engage the male tread and the female threaded portion, and a compression meter indicating when a maximum applied longitudinal force is exceeded, wherein the compression meter comprises a spring and a visual indicator such that, when the spring of the compression meter is compressed to a predefined point, the visual indicator indicates that a predetermined longitudinally oriented compression force has been applied to the pole system, wherein the visual indicator becomes entirely obstructed when the maximum force is applied.

21. The pole mount of claim 20, wherein the head comprises:

a first portion, a portion of the first portion extending into an interior of the pole; and a second portion that extends transverse to the first portion.

22. The pole mount of claim 20 further comprising:

a foot coupled to an end of the threaded rod; and a pivot between the foot and threaded rod so that the foot and threaded rod pivot relative to each other.

23. The pole mount of claim 20, wherein the maximum longitudinal force is applied when the head is in a position where a lower surface of a portion of the head is in direct contact with an upper surface of a head end of the narrowest segment of the pole.

24. The pole mount of claim 23, wherein the visual indicator comprises a painted ring or reflective material that becomes obstructed when the maximum force is applied.

25. The pole mount of claim 20, wherein the compression meter further comprises a cap and a bottom portion;

wherein, when the spring of the compression meter is compressed, the spring is compressed between the cap and the bottom portion; and wherein the visual indicator becomes entirely obstructed by at least one of the cap and the bottom portion when the maximum force is applied.

26. A pole mount, comprising:

a length-adjustable pole;

a length-adjustment mechanism that adjusts a length of the pole;

a compression meter indicating when a maximum applied longitudinal force is exceeded, wherein the compression meter comprises a spring and a visual indicator such that, when the spring of the compression meter is compressed to a predefined point, the visual indicator indicates that a predetermined longitudinally oriented compression force has been applied to the pole by the length-adjustment mechanism, wherein the compression meter further comprises a cap and a bottom portion;

wherein, when the spring of the compression meter is compressed, the spring is compressed between the cap and the bottom portion; and wherein the visual indicator becomes entirely obstructed by at least one of the cap or the bottom portion when the maximum force is applied wherein the visual indicator comprises a painted ring or reflective material that becomes obstructed when the maximum force is applied.

27. The pole mount of claim 26, wherein the length-adjustment mechanism comprises:

a quick-release mechanism that engages and disengages a female threaded portion having female threads, the quick-release mechanism fixedly coupled to the pole; and a threaded rod having a male thread corresponding to the female thread, such that when the quick release mechanism is in an engaged position the threaded rod slides freely through the female threaded portion and such that when the quick-release mechanism is in a disengaged position, the male thread and female threaded portion are engaged and can be rotated relative to each other.

* * * * *